US010895127B2

(12) United States Patent
Moyes

(10) Patent No.: US 10,895,127 B2
(45) Date of Patent: Jan. 19, 2021

(54) DOWNHOLE VALVE

(71) Applicant: Welleng Science and Technology Ltd, Banchory (GB)

(72) Inventor: Peter Moyes, Banchory (GB)

(73) Assignee: WELLENG SCIENCE AND TECHNOLOGY LTD., Aberdeenshire (GB)

( * ) Notice: Subject to any disclaimer, the term of this patent is extended or adjusted under 35 U.S.C. 154(b) by 313 days.

(21) Appl. No.: 15/766,526

(22) PCT Filed: Oct. 6, 2016

(86) PCT No.: PCT/GB2016/053110
§ 371 (c)(1),
(2) Date: Apr. 6, 2018

(87) PCT Pub. No.: WO2017/060707
PCT Pub. Date: Apr. 13, 2017

(65) Prior Publication Data

US 2018/0298727 A1 Oct. 18, 2018

(30) Foreign Application Priority Data

Oct. 8, 2015 (GB) ..... 1517765.2

(51) Int. Cl.
*E21B 34/14* (2006.01)
*E21B 34/10* (2006.01)

(52) U.S. Cl.
CPC ..... *E21B 34/101* (2013.01); *E21B 34/102* (2013.01); *E21B 34/14* (2013.01); *E21B 2200/04* (2020.05)

(58) Field of Classification Search
CPC ..... E21B 34/14; E21B 2034/002; E21B 2034/007; E21B 33/00; E21B 2200/04
See application file for complete search history.

(56) References Cited

U.S. PATENT DOCUMENTS 3,741,249 A 6/1973 Leutwyler
3,993,136 A * 11/1976 Mott ..... E21B 34/101 166/375

(Continued)

FOREIGN PATENT DOCUMENTS

GB 1422393 A 1/1976
GB 1461641 A 1/1977

(Continued)

OTHER PUBLICATIONS

GB Search Report dated May 13, 2016 for corresponding GB Application No. 1517765.2.

(Continued)

*Primary Examiner* — Shane Bomar
(74) *Attorney, Agent, or Firm* — Tarolli, Sundheim, Covell & Tummino LLP

(57) ABSTRACT

A downhole valve (18) comprises a housing and first and second sleeve assemblies (70 and 76) mounted within the housing (24) and defining an axial pocket (80) therebetween, wherein the first and second sleeve assemblies are arranged to be moved axially relative to each other. A valve member (32) is mounted within the axial pocket and is rotatable about a rotation axis in response to relative axial movement of the first and second sleeve assemblies from a closed position in which fluid flow through the downhole valve is restricted towards an open position in which fluid flow through the downhole valve is increased or permitted. An interface arrangement (94) axially extends from the second sleeve assembly and engages the valve member via an interface mechanism for converting relative axial movement of the first and second sleeve assemblies to rotation of the valve member.

27 Claims, 9 Drawing Sheets

(56) References Cited

U.S. PATENT DOCUMENTS

| | | | | |
|---|---|---|---|---|
| 4,254,836 | A * | 3/1981 | Russell | E21B 21/10 175/65 |
| 4,446,922 | A * | 5/1984 | Bowyer | E21B 34/10 166/322 |
| 4,651,829 | A * | 3/1987 | Hushbeck | E21B 34/12 166/321 |
| 5,636,661 | A * | 6/1997 | Moyes | E21B 34/14 137/614.2 |
| 5,992,520 | A | 11/1999 | Schultz et al. | |
| 6,125,930 | A * | 10/2000 | Moyes | E21B 34/103 166/66 |
| 2006/0272825 | A1* | 12/2006 | Royer | E21B 34/14 166/373 |
| 2009/0272544 | A1 | 11/2009 | Giroux et al. | |
| 2014/0144526 | A1 | 5/2014 | Russell | |
| 2016/0003701 | A1* | 1/2016 | Ringgenberg | E21B 47/06 166/317 |
| 2017/0234109 | A1* | 8/2017 | Smith | E21B 34/102 166/331 |
| 2017/0370189 | A1* | 12/2017 | MacDougall | E21B 31/005 |

FOREIGN PATENT DOCUMENTS

| | | | |
|---|---|---|---|
| GB | 1490438 | A | 11/1977 |
| WO | 97/05362 | A1 | 2/1997 |
| WO | 00/15943 | A1 | 3/2000 |
| WO | 2011/153098 | A | 12/2011 |
| WO | 2014/193405 | A1 | 12/2014 |
| WO | 2014/205424 | A2 | 12/2014 |
| WO | 2015/047254 | A1 | 4/2015 |

OTHER PUBLICATIONS

International Search Report and Written Opinion dated Feb. 21, 2017 for corresponding International Application No. PCT/GB2016/053110.

* cited by examiner

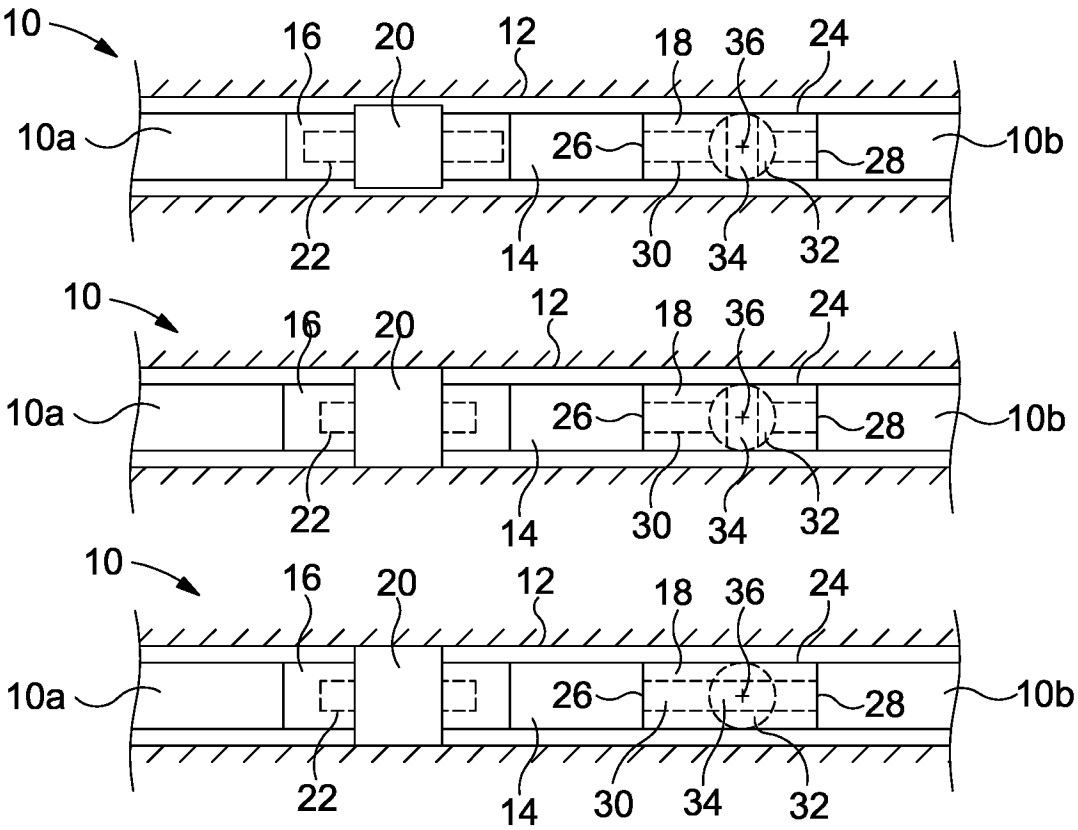
FIG. 1A
FIG. 1B
FIG. 1C
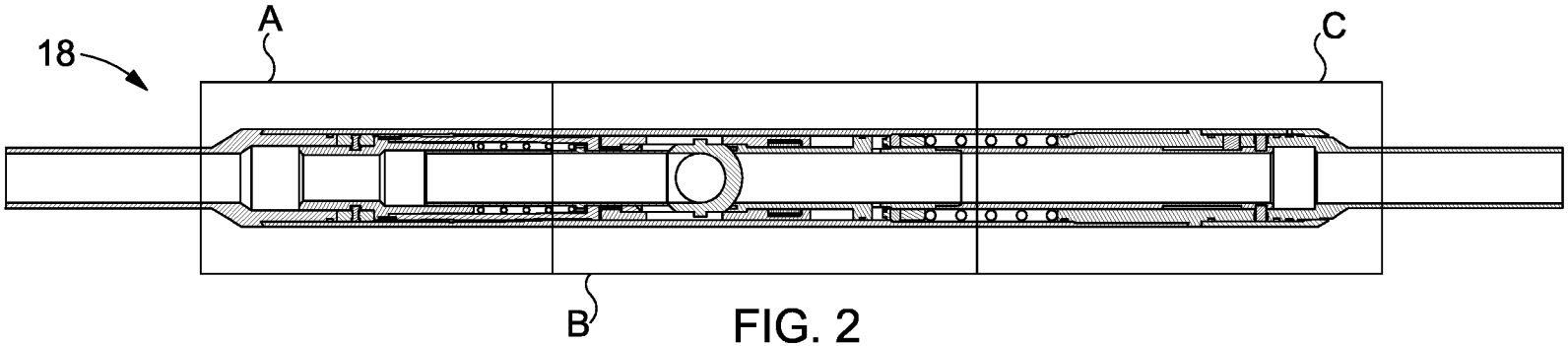
FIG. 2

DOWNHOLE VALVE

RELATED APPLICATIONS

The present application is a U.S. National Stage application under 35 USC 371 of PCT Application Serial No. PCT/GB2016/053110, filed on 6 Oct. 2016; which claims priority from GB Patent Application No. 1517765.2, filed 8 Oct. 2015, the entirety of both of which are incorporated herein by reference.

FIELD

The present invention relates to a downhole valve, such as might be used to close or restrict a downhole flow path, for example within a completion assembly.

BACKGROUND

Wellbore infrastructure and operations often require the use of valves to provide flow and/or pressure control. For example, valves may be used to control production and/or injection flow rates and pressures, to isolate sections of the wellbore, to contain wellbore pressure and fluids while topside operations are performed, to facilitate pressure testing, to facilitate tool actuation and the like.

In some examples valves may be used within completions to provide initial containment of pressure to facilitate downhole operations, such as to provide pressure testing, actuate other tools, such as pressure-set packers provided along a completion and the like. In this case the completion may have one or more openings which might otherwise prevent pressure containment. The use of a valve may provide temporary isolation of the one or more openings, allowing pressure to be elevated within the completion, which may then be used for setting other tools, testing purposes and the like.

In many cases when the necessary wellbore operations (e.g., testing, tool setting etc.) are completed, the barrier established by the valve should be removed, for example to permit bore access along the completion. There is a clear interest for all operators to utilise wellbore equipment which is robust and reliable, and as such the ability to reliably operate a valve to close/open is of critical importance, especially when any failure may establish a blockage in a completion.

Also, in some instances valve actuators may include complex structures, which may provide increased risk of failure, and in some cases may have space requirements which might reduce the available flow area within the completion.

SUMMARY

An aspect or embodiment of the present invention relates to a downhole valve, such as might be used in a downhole completion. The valve may comprise a housing. First and second sleeve assemblies may be mounted within the housing and may define an axial pocket therebetween. The first and second sleeve assemblies may be arranged to be moved axially relative to each other. A valve member may be mounted within the axial pocket. The valve member may be rotatable about a rotation axis during relative axial movement of the first and second sleeve assemblies from a closed position in which fluid flow through the downhole valve is restricted towards an open position in which fluid flow through the downhole valve is increased or permitted. The downhole valve may comprise an interface arrangement axially extending from the second sleeve assembly and engaging the valve member via an interface mechanism for converting relative axial movement of the first and second sleeve assemblies to rotation of the valve member.

An aspect or embodiment of the present invention relates to a downhole valve, comprising:

- a housing;
- first and second sleeve assemblies mounted within the housing and defining an axial pocket therebetween, wherein the first and second sleeve assemblies are arranged to be moved axially relative to each other;
- a valve member mounted within the axial pocket and being rotatable about a rotation axis in response to relative axial movement of the first and second sleeve assemblies from a closed position in which fluid flow through the downhole valve is restricted towards an open position in which fluid flow through the downhole valve is permitted; and
- an interface arrangement axially extending from the second sleeve assembly and engaging the valve member via an interface mechanism for converting relative axial movement of the first and second sleeve assemblies to rotation of the valve member.

The downhole valve may define a flow path therethrough. Flow along the flow path may be controlled by the valve member. The first and second sleeve assemblies may define at least a portion of a flow path extending through the downhole valve.

In use, relative axial movement of the first and second sleeve assemblies may cause relative axial movement of the valve member and the interface arrangement, permitting the valve member to rotate by interaction with the interface mechanism.

In some embodiments the valve member may be rotatable from an initially closed position to an open position. For example, the downhole valve may be deployed in a wellbore with the valve member in an initially closed position, and then caused to rotate towards an open position in response to relative axial movement of the first and second sleeve assemblies. Such an arrangement may facilitate wellbore operations, such as tool setting (e.g., a packer), which require the valve to be initially closed (e.g., to hold pressure for use in tool setting), and once such wellbore operations are completed the valve may be opened.

The valve member may be rotatable from its closed position towards its open position, and also from its open position towards its closed position. This may be achieved by relative axial movement of the first and second sleeve assemblies in reverse directions. Accordingly, the valve may be openable and closable.

Alternatively, the valve member may only be rotatable from its closed position to its open position, with reverse rotation prevented. Such an arrangement may provide a one-shot open valve arrangement. Reverse rotation of the valve member may be prevented by preventing reverse relative axial movement of the first and second sleeve assemblies. In some embodiments the valve may comprise a ratchet system for permitting relative axial movement of the first and second sleeve assemblies in a direction to cause the valve member to rotate from its closed position towards its open position, while preventing relative axial movement of the first and second sleeve assemblies in a reverse direction. Details of an optional ratchet system are presented below.

When the valve member is in its closed position the axial pocket defined between the first and second sleeve assemblies may be larger than the valve member (e.g., an axial extent of the valve member). Such an arrangement may permit the first and second sleeve assemblies to move axially relative to each other and reduce the size of the axial pocket and rotate the valve member towards its open position. However, in some embodiments where the axial pocket is larger than the valve member when said valve member is in its closed position, the first and second sleeve assemblies may be moved axially relative to each other to increase the size of the axial gap to cause the valve member to rotate towards its open position.

In some embodiments when the valve member is in its closed position the axial pocket defined between the first and second sleeve assemblies may be substantially the same size as the axial extent of the valve member. In such embodiments the first and second sleeve assemblies may move axially relative to each other to increase the size of the axial pocket and rotate the valve member towards its open position.

The valve member may be engageable with the first sleeve assembly. The valve member may be engageable with the first sleeve assembly when said valve member is in one or both of its closed and open positions. When the valve member is engaged with the first sleeve assembly relative axial movement between the first and second sleeve assemblies may also provide relative axial movement between the valve member and the second sleeve assembly, and thus the interface arrangement.

The valve member may be biased towards engagement with the first sleeve assembly. In such an arrangement the valve member may be biased towards a position such that relative axial movement between the first and second sleeve assemblies may also provide relative axial movement between the valve member and the second sleeve assembly, and thus the interface arrangement. Biasing of the valve member may seek to retain the valve member in engagement with the first sleeve assembly, for example during relative axial movement of the first and second sleeve assemblies.

The downhole valve may comprise a biasing arrangement for biasing the valve member towards engagement with the first sleeve assembly. At least a portion of the biasing arrangement may be mounted on the second sleeve assembly. The biasing arrangement may apply a bias force, such as an axial bias force, between the second sleeve assembly and the valve member, to bias the valve member towards the first sleeve assembly.

The biasing arrangement may comprise a bias force generator, such as a mechanical spring, gas spring or the like. The bias force generator may establish an axial bias force. The bias force generator may establish a bias force between the second sleeve assembly and the valve member. The bias force generator may directly engage the valve member.

The biasing arrangement may comprise a bias member interposed between the valve member and the bias force generator. In such an arrangement a biasing force may be applied against the valve member via the bias member.

The bias member may comprise a bias sleeve engaged against the valve member to facilitate biasing of the valve member into engagement with the first sleeve assembly.

The bias member may define a portion of a flow path extending through the downhole valve. In such an arrangement the bias member may comprise a flow tube. In one embodiment the bias member may comprise a load shoulder extending from a surface thereof, for example an outer surface thereof, wherein the bias force generator engages or acts against said load shoulder. The bias force generator may act between a first load shoulder defined on the bias member and a second load shoulder defined on the second sleeve assembly.

In one embodiment the bias member may be mounted internally of the second sleeve assembly to define an annular space therebetween, wherein the bias force generator, for example a compression spring, is located within the annular space, for example acting between first and second load shoulders of the bias member and the second sleeve, respectively.

The bias member may comprise an engaging surface for engaging the valve member. The engaging surface may define a dynamic engaging surface such that engagement between the valve member and bias member may be achieved during rotation of the valve member. This may permit bias force to be applied on the valve member during rotation. The engaging surface may define a profile which compliments a profile on the valve member. For example, the engaging surface may define a curved, for example part spherical, profile.

The bias member may engage the valve member without sealing therebetween. Such an arrangement may permit fluid/pressure communication across the point of engagement of the bias member and the valve member. Such fluid/pressure communication may facilitate actuation of the valve or the like. However, in alternative embodiments sealing may be provided between the bias member and the valve member.

The first sleeve assembly may comprise a first valve seat, wherein the valve member is engageable with said first valve seat. The first valve seat may define an axial edge or boundary of the axial pocket.

The valve member may be sealably engageable with the first valve seat. Sealed engagement of valve member and the first valve seat may establish or provide fluid/pressure control through the downhole valve. The valve member may be sealably engageable with the first valve seat at least when said valve member is in its closed position. Such an arrangement may permit the valve member, when closed, to prevent fluid/pressure communication across said valve member, at least in one direction. The first valve seat may comprise one or more sealing members. The valve member may comprise one or more sealing members.

The first valve seat may define a surface profile which compliments a surface profile of the valve member. The first valve seat may define a curved surface profile, such as a part spherical surface profile. The curved surface profile may be curved about a first centre point. The rotation axis of the valve member may extend through the first centre point. The rotation axis of the valve member may extend through the first centre point at least when the valve member is in its closed position. The rotation axis of the valve member may extend through the first centre point when the valve member is in both its closed and open positions, and optionally intermediate positions.

The second sleeve assembly may comprise a second valve seat. The second valve seat may define an axial edge or boundary of the axial pocket. The axial pocket may be defined between the first and second valve seats.

The valve member and the second valve seat may be disengaged (e.g., axially separated) when the valve member is in its closed position. The second valve seat may be engageable with the valve member at least when said valve member is in its open position. In some embodiments, when the valve member is in its open position said valve member may be engaged with both the first and second valve seats.

Engagement between the valve member and the second valve seat may be achieved without sealing therebetween. In alternative embodiments sealing may be provided or established during engagement of the second valve seat and the valve member.

The second valve seat may define a surface profile which compliments a surface profile of the valve member. The second valve seat may define a curved surface profile, such as a part spherical surface profile. The curved surface profile of the second valve seat may be curved about a second centre point. The rotation axis of the valve member may extend through the second centre point. The rotation axis of the valve member may extend through the second centre point when the valve member is in its open position, for example only when the valve member is in its open position. In such an arrangement, the first and second centre points may be axially separated when the valve member is in its closed position, and may be moved together to become substantially coincident when the valve member is in its open position.

The first sleeve assembly may be moveable within the housing. In such an arrangement the first sleeve assembly may be moveable relative to the second sleeve assembly to facilitate rotation of the valve member. In embodiments where the valve member is engaged with the first sleeve assembly, movement of the first sleeve assembly may cause corresponding movement of the valve member and thus relative movement between the valve member and the interface arrangement.

In some embodiments the first sleeve assembly may be moveable relative to the second sleeve assembly when said second sleeve assembly is stationary.

The second sleeve assembly may be moveable within the housing. In such an arrangement the second sleeve assembly may be moveable relative to the first sleeve assembly to facilitate rotation of the valve member. In embodiments where the valve member is engaged with the first sleeve assembly, the first sleeve assembly may hold the valve member such that movement of the second sleeve assembly will permit relative movement between the valve member and the interface arrangement.

In some embodiments the second sleeve assembly may be moveable relative to the first sleeve assembly when said first sleeve assembly is stationary.

Both the first and second sleeve assemblies may be moveable within the housing. Relative axial movement of the first and second sleeve assemblies may be caused by movement of both sleeve assemblies. Alternatively, relative axial movement of the first and second sleeve assemblies may be caused by movement of either sleeve assembly. Such an arrangement may provide contingency, for example in the event of any movement of one of the sleeve assemblies being compromised.

The downhole valve may comprise a primary mode of actuation in which one of the first and second sleeve assemblies is moved to provide rotation of the valve member. In some embodiments the primary mode of actuation may include movement of the first sleeve assembly relative to the second sleeve assembly.

The downhole valve may comprise a primary drive arrangement associated with one of the first and second sleeve assemblies. The sleeve assembly associated with the primary drive arrangement may be defined as the primary sleeve assembly. The primary drive arrangement may be for operating the downhole valve in its primary mode of actuation. The primary drive arrangement may be associated with the first sleeve assembly, for example for causing movement of the first sleeve assembly relative to the second sleeve assembly.

The primary drive arrangement may comprise a primary drive interface provided on, for example integrally formed with or coupled to, the primary sleeve assembly. The primary drive interface may be provided within an annular space defined between the primary sleeve assembly and the housing. The primary drive interface may permit a drive force to act on and drive the primary sleeve assembly. The drive force may comprise a pressure drive force, for example provided by fluid pressure within the downhole valve, pressure externally of the valve (e.g., hydrostatic wellbore pressure), or the like. The drive force may comprise a mechanical drive force.

The primary drive arrangement may comprise a primary drive force generator. The primary drive force generator may be for establishing a primary drive force suitable to cause relative movement of the first and second sleeve assemblies when the downhole valve is operated in its primary mode of actuation. The primary drive force generator may be arranged to generate a force against the primary drive interface.

The primary drive force generator may be positioned within an annulus defined between the primary sleeve assembly and the housing.

The primary drive force generator may comprise a pressure generating device, for example which operates via a gas generating chemical reaction or the like. The primary drive force generator may comprise an energy storage device, such as a spring, for example a mechanical spring, gas spring or the like. The energy storage device may be energised during assembly of the downhole valve. Alternatively, or additionally, the energy storage device may be energised while in situ.

In one embodiment the primary drive force generator may comprise a spring acting between, for example axially between, the housing and the primary sleeve assembly, for example between an axial load shoulder of the housing and the primary drive interface.

The primary drive arrangement may comprise a force isolator for initially isolating the primary drive force from acting on the primary sleeve assembly. The force isolator may be actuatable to permit the primary drive force to subsequently act on the primary sleeve assembly. The force isolator may therefore act as a trigger. The force isolator may be actuated upon receipt of a signal, such as an electromagnetic signal, optical signal, acoustic signal, pressure signal, mechanical signal or the like.

The force isolator may comprise an isolator member, for example an annular isolator member which may be positioned within an annulus defined between the primary sleeve assembly and the housing. The isolator member may be exposed to the primary drive force.

The isolator member may be initially separated from the primary drive interface to prevent the primary drive force from being applied on the primary drive interface and thus prevent any relative movement of the first and second sleeve assemblies to cause rotation of the valve member. Upon actuation of the force isolator the isolator member may move to engage the primary drive interface and thus allow the primary drive force to act on the primary sleeve assembly. Such movement of the isolator member may be achieved by the primary drive force.

The isolator member may comprise a stand-off arrangement for permitting one or more gaps to be defined between the isolator member and the primary drive interface during engagement therebetween. Such gaps may facilitate fluid flow between the isolator member and the primary drive interface when engaged. Such fluid flow may be present to allow pressure equalisation on opposing sides of the valve member prior to opening. The stand-off arrangement may comprise one or more axially extending members. The stand-off arrangement may comprise one or more axially extending castellations.

The isolator member may be initially secured, for example axially secured, to the housing, such that the primary drive force is initially directed into the housing, thus providing effective isolation of the primary drive force from the primary sleeve assembly.

The force isolator may comprise a releasable lock for initially locking the isolator member so as to prevent the primary drive force from acting on the primary sleeve assembly. Release of the releasable lock may cause actuation of the force isolator and application of the primary drive force on the primary sleeve assembly, for example via the isolator member. The releasable lock may comprise one or more dogs, for example one or more radial dogs. Such one or more radial dogs may be mounted within one or more associated radial pockets extending through the isolator member. The one or more dogs may engage a no-go profile within the housing, wherein the one or more dogs are radially held within the no-go profile. The one or more radial dogs may be radially supported, for example by the primary sleeve assembly, to retain engagement of the one or more dogs with the no-go profile. The radial dogs may be de-supported to permit release from the no-go profile.

The force isolator may be actuated upon preliminary movement of the primary sleeve assembly. The preliminary movement of the associated sleeve assembly may be in a release direction. The release direction may be in a direction opposite to that required to cause rotation of the valve member.

Preliminary movement of the primary sleeve assembly may not cause rotation of the valve member. In one embodiment, both the first and second sleeve assemblies may be moved in the release direction such that relative axial movement between the sleeve assemblies is not provided during the necessary preliminary movement of the primary sleeve assembly.

Preliminary movement of the primary sleeve assembly may de-support the one or more radial dogs, for example by permitting a recess formed on the primary sleeve assembly to become aligned with the one or more radial dogs.

Preliminary movement of the primary sleeve assembly may be provided by action of fluid pressure within the downhole valve acting on the primary sleeve assembly, for example acting on the primary drive interface of the primary sleeve assembly. In one embodiment pressure applied on one side of the valve member when closed may be communicated to the primary drive interface to establish preliminary movement of the primary sleeve assembly. Where the primary drive arrangement is associated with the first sleeve assembly, the pressure may be applied on the side of the valve member on which the second sleeve assembly is located.

Fluid pressure within the downhole valve may be deliberately increased to provide preliminary movement of the primary sleeve assembly. Fluid pressure within the downhole valve which provides preliminary movement of the primary sleeve assembly may also be used in other downhole operations, for example for use in operating other tools, such as downhole packers or the like.

The downhole valve may be arranged such that the required fluid pressure to initiate the preliminary movement of the primary sleeve assembly may be sufficient to retain the primary drive force, such that upon initial release of the isolator member, the primary sleeve assembly is not moved by action of the primary drive force. This arrangement may assist to prevent any rapid action within the downhole valve, for example when one side of the valve member is highly pressurised. Furthermore, this arrangement may prevent the valve member from opening until any necessary pressure related operations are completed.

In some embodiments the primary sleeve assembly may be initially restrained against movement by a releasable lock arrangement. The releasable lock arrangement may initially restrain the primary sleeve relative to the housing. The pressure required to activate the releasable lock arrangement may also be sufficient to retain the primary drive force.

The releasable lock arrangement may comprise or be defined by a shear arrangement. The releasable lock arrangement may comprise one or more frangible members, such as shear screws, pins, rings or the like. In one embodiment the releasable lock arrangement may comprise one or more frangible members which initially directly engage the primary sleeve assembly.

The releasable lock arrangement may comprise a locking sleeve initially engaged with the primary sleeve, wherein the locking sleeve may be initially retained against movement. In one embodiment the locking sleeve may be positioned on one axial side of the primary sleeve assembly. In one embodiment the locking sleeve may be initially retained against movement by one or more frangible members, such as shear screws, pins or the like. In one embodiment preliminary movement of the primary sleeve assembly may cause release of the locking sleeve, for example by shearing of the frangible members. Subsequent movement (for example reverse movement) of the primary sleeve assembly to provide for rotation of the valve member may be achieved without movement of the locking sleeve. In such an arrangement the risk of binding of the primary sleeve assembly, for example by the released or sheared locking members, may be minimised.

In some embodiments the primary drive force may act to move the primary sleeve assembly, following release of the isolator member, upon reduction of the pressure used to cause preliminary movement of said primary sleeve assembly.

In some embodiments the primary drive force may act to move the primary sleeve assembly, following release of the isolator member, upon bleeding of pressure across the valve member. Such pressure bleeding may function to reduce any pressure differential across the valve member.

In one embodiment the primary drive interface may be sealingly engaged with the housing such that fluid pressure within the downhole valve may act on the primary drive interface to cause the preliminary movement of the primary sleeve assembly. The housing may comprise a relief region, wherein alignment of the primary drive interface with the relief region may disrupt sealing engagement with the housing, such that the fluid/pressure may bypass the primary drive interface and permit pressure to equalise across the valve member.

In some embodiments the relief region may be provided by a no-go region for use in permitting the isolator member to be secured relative to the housing, for example via one or more dogs.

The downhole valve may comprise a sealing assembly for providing sealing engagement between the primary drive interface and the housing. In one embodiment the sealing assembly may comprise one or more seal members, such as O-rings, mounted on the primary drive interface and arranged to engage a sealing surface provided on the housing. Accordingly, when the primary drive interface is aligned with the sealing surface, sealing may be provided, and when the primary drive interface is aligned with the relief region sealing may be disrupted.

In one embodiment at least one and in some embodiments all seal members may be radially retained relative to the primary drive interface. Such an arrangement may minimise the risk of one or more seal members becoming disrupted or washed out by initiation of flow upon alignment of the primary drive interface with the relief region. Such disruption or wash-out may otherwise cause one or more seal members to adversely bind against the housing during any reverse movement of the primary sleeve assembly, for example to cause rotation of the valve member.

The sealing arrangement may comprise a seal retaining mechanism to radially retain one or more seal members. The seal retaining mechanism may comprise a radial clamp arrangement.

As fluid pressure will be relieved as soon as the primary drive arrangement is aligned with the relief region a certain degree of momentum of the primary sleeve assembly may be required to ensure said primary sleeve assembly continues its preliminary movement, beyond the immediate point of alignment with the relief region, to sufficiently actuate or release the force isolator. Such momentum may be achieved by user controlled application of fluid pressure, for example. Further, such momentum may be achieved by reducing or minimising any potential drag within the downhole valve, for example by engaging features such as within ratchet mechanisms or the like.

However, the present inventor recognises that too much momentum may generate adverse impulse forces on certain elements of the downhole valve at the end of the preliminary movement. For example, features of the interface arrangement and interface mechanism could potentially be compromised if exposed to significant impulse forces. In some embodiments this issue may be alleviated by careful design of component parts to control, for example minimise, their mass, while still achieving sufficient strength.

Further, in some embodiments the downhole valve may comprise at least one energy absorber arranged to absorb energy of moving parts within said downhole valve. For example, the downhole valve may comprise one or more crumple zones or features, arranged to deform and absorb energy from, for example, the primary sleeve assembly at the end of its preliminary movement.

The downhole valve may comprise a movement limiter, arranged to limit movement of components within said downhole valve at a position which prevents adverse impulse loading to be applied between essential or critical functional elements of the valve. In one embodiment the movement limiter may comprise a pin and slot or key and key-way arrangement.

The primary sleeve assembly may comprise one or more ports therein to permit communication of fluid which has bypassed the primary drive interface into the primary sleeve assembly. This may assist to provide pressure equalisation across the valve member.

The downhole valve may comprise a secondary mode of actuation. Thus, the downhole valve may comprise a primary mode of actuation in which one of the first and second sleeve assemblies is moved to provide rotation of the valve member, and a secondary mode of actuation in which the other of the first and second sleeve assemblies is moved to provide rotation of the valve member.

In some embodiments the secondary mode of actuation may include movement of the second sleeve assembly relative to the first sleeve assembly.

The secondary mode of actuation may provide contingency in the event that the primary mode of actuation is not possible, for example if movement of one of the first and second sleeve assemblies (e.g., the primary sleeve assembly) is compromised.

The downhole valve may comprise a secondary drive arrangement associated with one of the first and second sleeve assemblies. The sleeve assembly associated with the secondary drive arrangement may be defined as the secondary sleeve assembly. The secondary drive arrangement may be for operating the downhole valve in its secondary mode of actuation. The secondary drive arrangement may be associated with the second sleeve assembly, for example for causing movement of the second sleeve assembly relative to the first sleeve assembly.

The secondary drive arrangement may comprise a secondary drive interface provided on, for example integrally formed with or coupled to, the secondary sleeve assembly. The secondary drive interface may permit a drive force to act on and drive the secondary sleeve assembly. The drive force may comprise a pressure drive force, for example provided by fluid pressure within the downhole valve, pressure externally of the valve (e.g., hydrostatic wellbore pressure), or the like. The drive force may comprise a mechanical drive force.

In some embodiments the secondary drive interface may be configured to be engaged by a separate tool deployed through the downhole valve. The separate downhole tool may be wireline deployed, tubing deployed, tractor deployed or the like. The separate downhole tool may be engaged with the secondary drive interface, and then manipulated to cause required movement of the secondary sleeve assembly.

The downhole valve may be configured to prevent fluid flow in reverse directions through said valve when the valve member is in its closed position.

The downhole valve may be configured to prevent fluid flow in only one direction through said valve when the valve member is in its closed position.

In one embodiment, when the valve member is in its closed position fluid pressure from the second sleeve assembly side may act to bias the valve member against the first sleeve assembly to assist sealing against said first sleeve assembly. In this way, fluid flow and pressure may be retained on the second sleeve assembly side of the valve member.

When the valve member is in its closed position fluid pressure from the first sleeve assembly side may act to lift the valve member off the first sleeve assembly to allow fluid to flow past the valve member. Such an arrangement may permit filling of the valve and any associated flow conduit, such as a completion, during deployment into a wellbore. Accordingly, the valve may define a pump-through or self-filling valve.

The first and second sleeve assemblies may be oriented in accordance with desired flow/pressure containment requirements. For example, the first sleeve may be positioned below the second sleeve (relative to a wellbore) when flow/pressure containment from above the valve member is required. Alternatively, the first sleeve may be positioned above the second sleeve (relative to a wellbore) when flow/pressure containment from below the valve member is required.

The interface arrangement may comprise an interface member axially extending from the second sleeve assembly.

The interface mechanism may be provided between the interface member and the valve member. In some embodiments the interface mechanism may be defined by both the interface member and the valve member.

In one embodiment the interface mechanism may comprise a yoke mechanism.

The interface mechanism may comprise a rotation pin provided on the valve member and aligned with the rotation axis of the valve member, and an axially extending slot provided on the interface member which receives the rotation pin. One of the valve member and the interface member may comprise a drive slot laterally offset, for example eccentrically arranged, relative to the rotation axis of the valve member and axially extending slot of the interface member. The other of the valve member and the interface member may comprise a drive pin, also laterally offset relative to the rotation axis of the valve member and axially extending slot of the interface member. In such an arrangement, relative axial movement of the valve member and the interface member permits the rotation pin of the valve member to axially slide within the elongate slot of the interface member, while the drive pin and drive slot interaction causes rotation of the valve member.

The interface member may be axially secured relative to the second sleeve assembly.

The interface member may extend across the axial pocket defined between the first and second sleeve assemblies. The interface member may extend from the second sleeve assembly to engage the first sleeve assembly. The interface member may slidably engage the first sleeve assembly. Such an arrangement may permit the first and second sleeve assemblies to be moved axially relative to each other.

The interface member and the first sleeve assembly may engage each other via respective flat surfaces. Such an arrangement may permit the first sleeve assembly and interface member, and thus second sleeve assembly, to be rotatably coupled together.

A single interface member may be provided. Alternatively, multiple interface members may be provided. In one embodiment a pair of interface members may be provided, which interface members may be diametrically opposed to each other.

The downhole valve may comprise a ratchet system for permitting relative axial movement of the first and second sleeve assemblies in a single direction. The ratchet system may permit the first and second sleeve assemblies to move relative to each other to cause the valve member to rotate from its closed position towards its open position. The ratchet system may prevent the first and second sleeve assemblies from moving relative to each other in a direction which would cause the valve member to move towards its closed position.

The ratchet system may be provided or formed between the interface arrangement and the first sleeve assembly. For example, the ratchet system may be provided or formed between the interface member and the first sleeve assembly. The ratchet system may include a ratchet profile on one of the interface arrangement and first sleeve assembly and a ratchet member or members on the other of the interface arrangement and the first sleeve assembly. In one embodiment the first sleeve assembly may include a ratchet profile and the interface arrangement may support a ratchet member. In one embodiment the interface arrangement may define a pocket for receiving the ratchet member. The ratchet member may be generally ring-shaped. The ratchet member may comprise a C-ring or split ring.

One or both of the first and second sleeve assemblies may be rotatably fixed relative to the housing, for example by a key and key-way arrangement.

One of the first and second sleeve assemblies may include a ratchet mechanism configured to permit unidirectional movement of the associated sleeve member relative to the housing. The second sleeve may comprise a ratchet mechanism. In some embodiments the ratchet mechanism may be arranged to minimise drag forces applied to the first and/or second sleeve assemblies. For example, in one embodiment the ratchet mechanism may be provided on a region of reduced diameter which may reduce a ratchet contact surface area, effectively minimising drag forces.

The second sleeve assembly may be initially secured relative to the housing, for example via a shear arrangement.

The valve member may comprise a ball member. In such an arrangement the valve member may include one or more spherical surfaces.

The valve member may define a through bore which facilitates flow through the downhole valve when the valve member is open. The through bore may be generally perpendicular relative to the rotational axis of the valve member.

The valve member may include a blind bore extending generally transverse to the through bore. The blind bore may merge with the through bore. The blind bore may facilitate fluid communication from one side of the valve member to a primary drive arrangement.

When the valve member is in its closed position the blind bore may be directed to the second sleeve assembly side of the valve member. In some embodiments, when the valve member is in its closed position an axis of the blind bore may be generally aligned with, for example parallel to, coaxial with or the like, a flow path extending through the downhole valve.

In some embodiments, the blind bore may function to assist in machining of the valve member when in situ, for example during a contingency operation in which the valve member needs to be removed, for example in a drilling or milling operation. In such an arrangement, the blind bore may present less material to be machined. Further, the blind bore may facilitate centering of any machine tool, such as a milling machine, drilling machine or the like. This may minimise the risk or occurrence of a machine tool kicking-off the valve member and possibly damaging other components, such as the housing.

The valve member may comprise one or an opposing pair of flattened regions for forming part of the interface mechanism.

The housing may comprise connectors for permitting the downhole valve to be secured in-line with a tubing system, such as a completion.

An aspect or embodiment of the present invention relates to a downhole valve, comprising:

a housing; and a valve cartridge mounted within the housing.

The valve cartridge may comprise first and second sleeve assemblies mounted within the housing and defining an axial pocket therebetween, wherein the first and second sleeve assemblies are arranged to be moved axially relative to each other.

The valve cartridge may comprise a valve member mounted within the axial pocket and being rotatable about a rotation axis in response to relative axial movement of the first and second sleeve assemblies from a closed position in which fluid flow through the downhole valve is restricted towards an open position in which fluid flow through the downhole valve is permitted The valve cartridge may comprise an interface arrangement axially extending from the second sleeve assembly and engaging the valve member via an interface mechanism for converting relative axial movement of the first and second sleeve assemblies to rotation of the valve member.

An aspect or embodiment of the present invention relates to a valve cartridge for mounting within a housing.

An aspect or embodiment of the present invention relates to a method for controlling flow downhole, comprising:

positioning a valve member of a downhole valve in a closed position, wherein the valve member is located in an axial pocket defined between first and second sleeve assemblies; and establishing relative axial movement between the first and second sleeve assemblies to cause the valve member to rotate from its closed position to an open position.

The method may be provided by use of a downhole valve according to any other aspect.

The method may comprise operating the downhole valve in a primary mode of actuation, in which the first sleeve assembly is moved relative to the second sleeve assembly to rotate the valve.

The method may comprise operating the downhole valve in a secondary mode of actuation, in which the second sleeve assembly is moved relative to the first sleeve assembly to rotate the valve. The secondary mode of actuation may be utilised in the event that the primary mode of actuation is not permitted.

An aspect or embodiment of the present invention relates to a downhole completion assembly, comprising:

a downhole pressure actuatable tool; and a downhole valve according to any other aspect.

The downhole valve may be operable to contain pressure within the downhole completion assembly to allow the downhole tool to be actuated, and then subsequently opened to establish bore access through the completion.

The downhole valve may be operated or actuated to move to an open position in response to pressure, for example pressure used to actuate the downhole tool.

The downhole pressure actuatable tool may be mounted or positioned above the downhole valve, i.e., uphole of the downhole valve.

The downhole pressure actuatable tool may comprise a packer, further valve, sliding sleeve assembly, or the like.

An aspect or embodiment of the present invention relates to a valve member, such as a valve member defined in accordance or in connection with any other aspect.

An aspect or embodiment of the present invention relates to a downhole packer assembly, comprising:

a packer member operable from a retracted position to an extended position to permit setting within a wellbore;

a pressure operated packer actuator for actuating the packer member; and a downhole valve according to any other aspect of the invention.

The downhole valve may be configured in a closed position, for example an initially closed position, to permit pressure to be developed to operate the packer actuator and thus allow the packer member to become set. The downhole valve may be configured in an open position, for example a subsequent open position, following setting of the packer.

An aspect or embodiment of the present invention relates to a downhole valve, comprising:

a housing:

a valve member mounted within the housing and being rotatable from a closed position to an open position, wherein the valve member is axially moveable within the housing to permit said valve member to be rotated.

An aspect or embodiment of the present invention relates to a downhole valve, comprising:

a housing;

first and second sleeve assemblies mounted within the housing and defining an axial pocket therebetween; and a valve member mounted within the axial pocket and being rotatable about a rotation axis in response to relative axial movement of the first and second sleeve assemblies from a closed position in which fluid flow through the downhole valve is restricted towards an open position in which fluid flow through the downhole valve is permitted;

wherein the valve is operable in a primary mode of actuation in which the first sleeve assembly is axially moved towards the second sleeve assembly to cause rotation of the valve member, and a secondary mode of actuation in which the second sleeve assembly is axially moved towards the first sleeve assembly to cause rotation of the valve member.

The downhole valve may comprise a primary force generator for use in operating the valve in the primary mode of operation. In such an arrangement the downhole valve may be operated in its primary mode of actuation by activation of the primary force generator. In such an arrangement the primary mode of actuation may include an automatic mode of actuation.

The downhole valve may be operated in its secondary mode of operation by deployment of an actuation tool into the downhole valve. In such an arrangement the secondary mode of actuation may include a manual mode of actuation.

An aspect or embodiment relates to a downhole apparatus comprising:

a housing defining a sealing surface and a region of relief positioned adjacent the sealing surface;

an actuatable member moveably mounted within the housing and arranged to be actuated to move in reverse directions; and a sealing arrangement mounted on the actuatable member, wherein the actuatable member is configurable from a first position in which the sealing arrangement is aligned with and sealingly engages the sealing surface of the housing to provide sealing between the housing and the actuatable member, and a second position in which the sealing arrangement is aligned with region of relief to disrupt sealing between the housing and the actuatable member, wherein the sealing arrangement comprises a sealing member which is radially retrained on the actuatable member to prevent radial movement of said sealing member when the actuatable member is in its second position.

Accordingly, the risk of the seal member becoming inadvertently radially displaced, for example by initiation of flow when the actuatable member is in its second position, may be minimised. Accordingly, reverse movement of the actuatable member form its second position towards its first position may be achieved substantially unhindered (other than any intentional seal interference) by any such inadvertent radial seal displacement.

Features defined in relation to one aspect of the invention may be provided in combination with any other aspect of the invention.

BRIEF DESCRIPTION OF THE DRAWINGS

These and other aspects of the present invention will now be described, by way of example only, with reference to the accompanying drawings, in which:

FIG. 1A is a diagrammatic illustration of a completion assembly, according to an embodiment of the present invention, in a first stage of deployment into a wellbore.

FIG. 1B illustrates the completion of FIG. 1A in a second stage of deployment.

FIG. 1C illustrates the complete of FIG. 1A in a third stage of deployment.

FIG. 2 is a longitudinal cross-sectional view of a downhole valve in accordance with an embodiment of the present invention, wherein the valve is shown in an initial closed configuration.

DETAILED DESCRIPTION OF THE INVENTION

Figure 3:
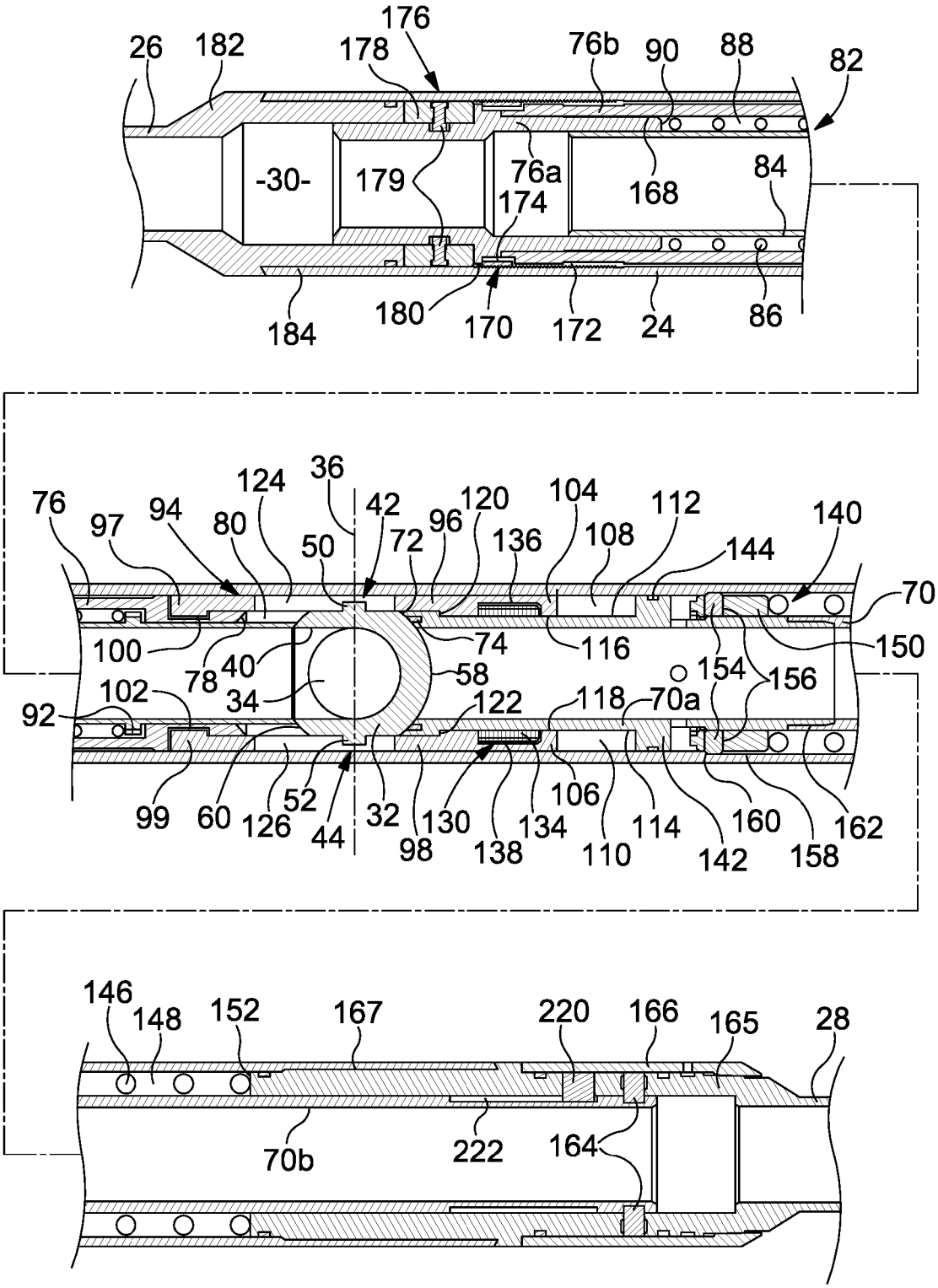
FIG. 3 provides enlarged views of adjacent sections A, B, C of the downhole valve of FIG. 2.

Aspects of the invention relate to a downhole valve which may be used in numerous downhole applications, for example to provide an initial closed/sealed fluid path to facilitate a downhole operation, and subsequently operated to open the fluid path. One exemplary embodiment is described below, in which a downhole valve according to an embodiment of the invention is used to support actuation of a downhole pressure-set packer.

FIGS. 1A to 1C provide diagrammatic illustrations of the sequential installation of a completion assembly, generally identified by reference numeral 10, within a wellbore 12. The wellbore 12 may be lined or alternatively may be open hole. The portion of the completion assembly 10 shown in FIGS. 1A to 1C includes tubing sections 14, a packer 16 and a downhole valve 18.

The packer 16 includes an expandable packer element 20 and a pressure operated packer actuator 22 (shown in broken outline), wherein the packer element 16 is provided in a retracted or unset position in FIG. 1A, allowing the completion assembly 10 to be inserted into the wellbore 12 to align the packer 16 at the required wellbore location or zone. The packer element 16 is formed of a compressible material, such as a rubber material, and is arranged to be axially compressed by the packer actuator 22 to allow the packer element 16 to expand radially outwardly, as known in the art.

The downhole valve 18 includes a housing 24 which is coupled to the completion tubing 14 via upper and lower connectors 26, 28, and a flow path 30 (shown in broken outline) extends through the housing 24 between the connectors 26, 28. The valve 18 includes a rotatable valve member 32 (also shown in broken outline) generally in the form of a ball which includes a throughbore 34, wherein the valve member 32 is rotatable about a rotation axis 36. The valve member 32 is illustrated in FIG. 1A in a closed position, in which the throughbore 34 is not aligned with the flow path 30, thus isolating upper and lower sections 10*a*, 10*b* of the completion 10. In particular, the valve 18 is arranged such that a pressure differential from above can be supported, allowing pressure in the upper completion section 10*a* to be elevated, providing a necessary pressure to operate the packer 16. However, in the present embodiment the valve 18 is arranged such that a pressure differential from below is not supported. This may therefore allow the completion 10 to fill, from below the valve 18, during deployment of the completion 10 into the wellbore 12.

Figure 10:
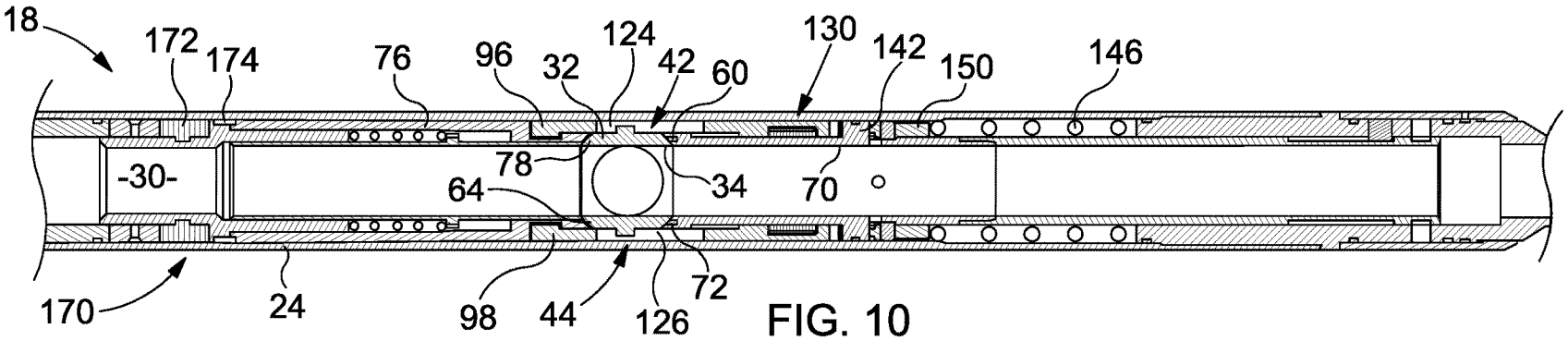
FIG. 10 is a longitudinal sectional view of the downhole valve of FIG. 2, wherein the valve is shown in an open configuration.

As noted above, the valve 18, when closed, permits pressure within the upper completion section 10*a* to be elevated, thus allowing the packer 16 to be pressure operated and set, as illustrated in FIG. 1B, in which the packer element 20 is radially expanded by the packer actuator 22 to sealably engage the wall of the wellbore 12. Subsequent to this, as illustrated in FIG. 10, the valve member 32 is caused to rotate to align the throughbore 34 of the valve member 32 with the flow path 30 through the valve housing 24, thus establishing bore access along the completion 10. As will be described in more detail below, the valve 18 is operable in a primary mode of actuation in which the valve member 32 is triggered to open in response to elevated pressure within the upper completion section 10*a*. Thus, pressure within the upper completion may be used to set the packer 16 and also trigger the valve 18 to open. However, as will also be described in further detail below, the valve 18 may be operable in a secondary mode of actuation in the event that the primary mode of actuation is not possible.

FIG. 2 provides a longitudinal cross-sectional view of the downhole valve 18, and for purposes of clarity FIG. 3 provides enlarged views of adjacent sections A, B, C of FIG. 2. The subsequent description is made primarily with reference to FIG. 3, with FIG. 2 providing a useful global illustration of the valve 18.

As noted above, the valve 18 includes a housing 24 which defines a flow path 30 extending between upper and lower connectors 26, 28, with a rotatable valve member 32 provided within the housing 24 to control flow along the flow path 30. In FIGS. 2 and 3 the valve member 32 is shown in a closed position in which the throughbore 34 is not aligned with the flow path 30.

Figure 4A:
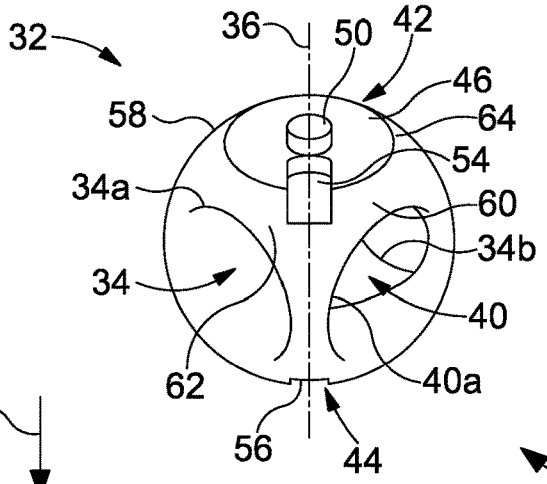
FIG. 4A is a perspective view of a valve member of the downhole valve of FIG. 2.
Figure 4B:
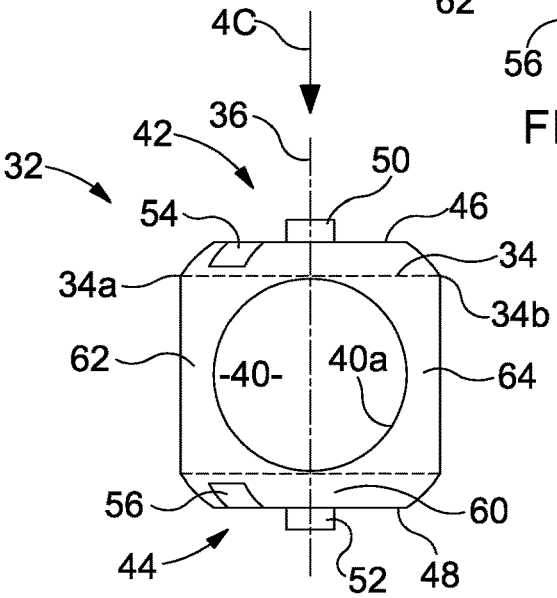
FIGS. 4B and 4C are different elevation views of the valve member.
Figure 4C:
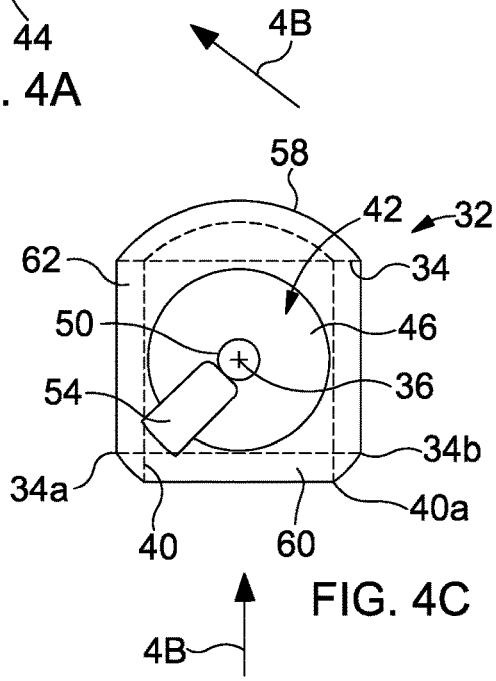

The valve member 32 is illustrated in isolation in FIGS. 4A to 4C, with FIG. 4A providing a perspective view, FIG. 4B providing an elevation view in the direction of arrow 4B in FIG. 4A (and FIG. 4C), and FIG. 4C providing an alternative elevation view in the direction of arrow 4C of FIG. 4B. As noted above, the valve member 32 is generally ball shaped and is rotatable about rotation axis 36. The throughbore 34 extends transverse to the rotation axis 36 from diametrically opposed openings 34*a*, 34*b* formed in the outer surface of the valve member 32. A blind bore 40 extends into the valve member 32 from an opening 40*a* to merge with the throughbore 34, wherein the blind bore 40 is transverse to both the throughbore 34 and the rotation axis 36. The surfaces of the valve member which contain the bore openings 34*a*, 34*b*, 40*a* are all truncated in the illustrated embodiment.

The valve member 32 includes diametrically opposed, first and second drive structures 42, 44 provided on respective first and second flat surface 46, 48 of the valve member 32, wherein the drive structures 42, 44 function to permit the valve member 32 to be rotated about its rotation axis 36, as will be described in further detail below. The drive structures 42, 44 may define a portion of an interface mechanism, as also further described in detail below. The first drive structure includes a rotation pin aligned with the rotation axis 36, and a first drive slot 54 extending generally radially outwardly from the rotation axis. Similarly, the second drive structure 44 includes a second rotation pin 52 aligned with the rotation axis 36, and a second drive slot 56 extending generally radially outwardly from the rotation axis 36.

The valve member 32 further includes a first bearing surface 58 on a closed side of the valve member 32, a second bearing surface 60 which surrounds the opening 40*a* of the blind bore 40, a third bearing surface 62 which surrounds opening 34*a*, and a fourth bearing surface 64 which surrounds opening 34*b*.

Referring again to FIG. 3, the valve 18 includes a first sleeve assembly 70 mounted in the housing 24 on one side of the valve member 32 (on the downhole side of the valve member 32 in the example embodiment illustrated). The first sleeve assembly includes a first valve seat 72 which carries a seal 74.

The valve 18 further includes a second sleeve assembly 76 mounted in the housing on an opposite side of the valve member 32 (on the uphole side of the valve member 32 in the example embodiment illustrated), wherein the second sleeve assembly includes a second valve seat 78.

An axial pocket 80 is defined between the first and second sleeve assemblies 70, 76, specifically between the first and second valve seats 72, 78. The valve member 32 is positioned within the axial pocket 80, and in the closed position shown in FIG. 3 the valve member 32 is engaged with the first valve seat 72 and separated from the second valve seat 78. More specifically, the first bearing surface 58 of the valve member 32 is engaged with the first valve seat 72. In such a configuration the axial pocket 80 may thus be considered to be larger than the axial extent of the valve member 32. As will be described in further detail below, relative axial movement of the first and second sleeve assemblies 70, 76 in a direction to close the axial pocket 80 causes the valve member 32 to rotate from its closed position to its open position. Accordingly, relative axial movement of the first and second sleeve assemblies 70, 76 provides actuation of the valve 18.

A biasing arrangement 82 is mounted on the second sleeve assembly 76 and includes a biasing sleeve 84 which axially engages the valve member 32, specifically the second bearing surface 60 of the valve member 32 in the closed configuration of FIG. 3. The biasing sleeve 84 may be defined as a flow sleeve in that it defines a portion of the flow path 30 through the valve 18. A biasing spring 86 is located in an annular space 88 defined between the second sleeve assembly 76 and the biasing sleeve 84 and acts between a load shoulder 90 on the second sleeve assembly 76 and a load shoulder in the form of an annular rib 92 on the biasing sleeve 84. Accordingly, the spring 86 generates a bias force which acts to bias the biasing sleeve 84 against the valve member 32, and thus biases the valve member 32 against the first valve seat 72.

Figure 5:
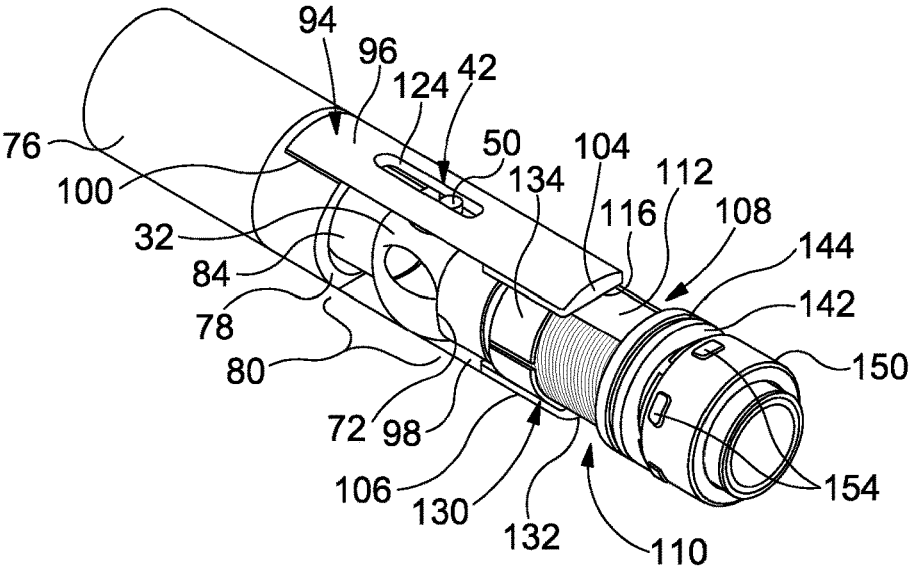
FIG. 5 is a perspective view of a valve cartridge of the downhole valve of FIG. 2.
Figure 6:
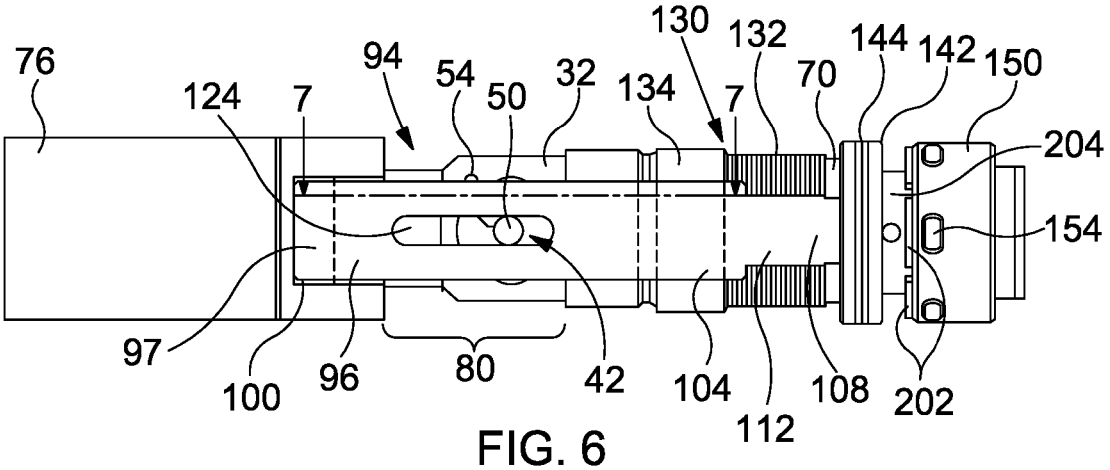
FIG. 6 is an elevation view of the valve cartridge of FIG. 5.
Figure 7:
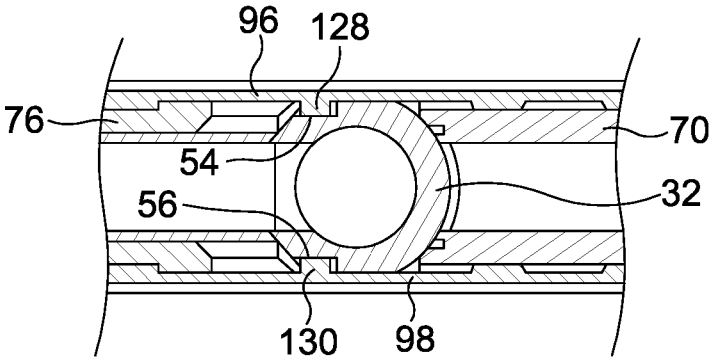
FIG. 7 is a sectional view taken along line 7-7 of FIG. 6.

The description that follows is made with reference to FIGS. 3 and 5 to 7 in combination, wherein FIG. 5 is a perspective view of internal components of the valve 18, removed from the valve housing 24, FIG. 6 is an elevation view of the internal components of FIG. 5, and FIG. 7 is a sectional view taken along line 7-7 of FIG. 6.

The downhole valve 18 further includes an interface arrangement 94 extending between the first and second sleeve assemblies 70, 76 wherein the interface arrangement 94 engages with the opposed first and second drive structures 42, 44 of the valve member 32 to establish an interface mechanism which functions to cause rotation of the valve member 32 upon relative axial movement of the first and second sleeve assemblies 70, 76.

The interface arrangement 94 in the present embodiment includes first and second diametrically opposed interface arms 96, 98 which extend from the second sleeve assembly 76 to the first sleeve assembly 70, spanning the axial pocket 80. The first and second interface arms 96, 98 are configured similarly and each include a hook profile 97, 99 at one end which is received in respective hook pockets 100, 102 formed in the second sleeve assembly 76. The hook pockets 100, 102 compliment the shape of the respective hook profiles 97, 99, such that the first and second interface arms 96, 98 are axially secured/fixed to the second sleeve assembly 76.

An opposite end of each interface arm 96, 98 includes an upset portion 104, 106 which is received within respective elongate recesses 108, 110 on diametrically opposed regions of the first sleeve assembly 70. The base of each elongate recess 108, 110 is defined by respective planar surfaces 112, 114, wherein the inner face of each upset portion 104, 106 is defined by respective complimentary planar surfaces 116, 118. Thus, engagement of the respective planar surface 112, 116 and 114, 118 functions to rotationally lock the first and second sleeve assemblies 70, 76 together.

When the valve member 32 is in its closed position, as illustrated, relative movement between the first and second sleeve assemblies 70, 76 to increase the size of the axial pocket 80 is prevented by engagement of the upset portions 104, 106 with respective shoulders 120, 122 which form an edge of the respective elongate recesses 108, 110.

However, the elongate recesses 108, 110 are axially longer than the respective upset portions 104, 106, and as such relative axial movement of the first and second sleeve assemblies 70, 76 in a direction to close the axial gap 80 is possible.

The first interface arm 96 defines a first axially extending elongate slot 124, and similarly the second interface arm 98 defines a second axially extending elongate slot 126. The first rotation pin 50 of the valve member 32 is slidably received in the first elongate slot 124, and the second rotation pin 52 of the valve member 32 is slidably received within the second elongate slot 126. As illustrated in the sectional view of FIG. 7, the first interface arm 96 includes a first drive pin 128 which is laterally offset from the first elongate slot and is engaged within the first drive slot 54 formed in the valve member 32. Similarly, the second interface arm 98 includes a second drive pin 130 which is laterally offset from the second elongate slot 126 and is engaged within the second drive slot 54 formed in the valve member 32. Accordingly, the interface arms 96, 98 and drive structures 42, 44 of the valve member 32 may define a yoke mechanism.

Accordingly, relative axial movement of the valve member 32 and the first and second interface arms 96, 98, established by relative axial movement of the first and second sleeve assemblies 70, 76 causes the valve member 32 to rotate about its axis 36.

The valve 18 includes a ratchet system 130 provided between the first sleeve assembly 70 and the first and second interface arms 96, 98 and configured to permit relative movement of the first and second sleeve assemblies 70, 76 only in a direction which causes the valve member 32 to rotate from its closed position towards an open position. Accordingly, reverse rotation of the valve member 32 is not permitted, such that the valve 18 in the embodiment shown may define a one-shot open valve.

The ratchet system 130 includes an outwardly facing ratchet profile 132 formed on the first sleeve assembly 70, and a split ratchet ring 134 which circumscribes the first sleeve assembly 70 and includes an inwardly facing corresponding ratchet profile. The ratchet ring 134 is axially captivated in arcuate channels 136, 138 formed in the respective upset portions 104, 106 of the first and second interface arms 96, 98. The corresponding ratchet profiles axially slide over each other during movement of the first and second sleeve assemblies 70, 76 in a direction to cause the valve member 32 to rotate in an opening direction, whereas the corresponding ratchet profiles axially lock together to prevent reverse movement.

The valve 18 further comprises a primary drive arrangement, generally identified by reference numeral 140, associated with the first sleeve assembly 70 and for causing movement of the first sleeve assembly 70 relative to the second sleeve assembly 76. The primary drive arrangement 140 is for operating the downhole valve 18 in its primary mode of actuation.

The primary drive arrangement 140 comprises a primary drive interface in the form of a circumferential rib 142 formed on the first sleeve assembly 70. The circumferential rib 142 is sealably engaged with the housing 24 via a seal member 144, and thus defines a piston arrangement.

The primary drive arrangement 140 comprises a primary drive force generator in the form of a power spring 146 located in an annular space 148 formed between the first sleeve assembly 70 and the housing 24 on the downhole side of the circumferential rib 142. As described in more detail below, the power spring 146 functions to establish a sufficient primary drive force against the circumferential rib 142 to move the first sleeve assembly 70 relative to the second sleeve assembly 76 when the downhole valve 18 is operated in its primary mode of actuation.

The primary drive arrangement 140 also comprises a force isolator in the form of an isolator ring 150 which is located within the annular space 148, wherein the power spring 146 acts between the isolator ring 150 and a load shoulder 152 coupled to the housing 24. The isolator ring 150 functions to initially isolate the primary drive force from acting on the circumferential rib 142. The isolator ring 150 may therefore function as a trigger.

The isolator ring 150 is initially axially secured relative to the housing 24 via a plurality of dogs 154 which extend through respective radial pockets 156 in the isolator ring 150 and are received within a circumferential retaining recess 158 formed in the inner surface of the housing 24. When in the configuration of FIG. 3 the first sleeve assembly 70 radially supports the dogs 154 within the retaining recess 158, thus effectively locking the isolator ring 150 relative to the housing 24. The power spring 146 applies an axial force on the isolator ring 150 such that the dogs 154 engage a no-go profile 160 formed by the retaining recess 158. The isolator ring 150 is thus retained at a position which is separated from the circumferential rib 142, as illustrated in FIG. 3, to prevent the force of the power spring from being applied on said rib 142 and thus the first sleeve assembly 70. The release procedure of the isolator ring 150 during operation of the valve 18 in its primary mode of actuation will be described in detail later.

The first sleeve assembly 70 includes an upper portion 70*a* and a lower portion 70*b* coupled together via a threaded connection 162. The provision of the first and second positions facilitates ease of manufacture and assembly.

The lower portion 70*b* of the first sleeve assembly is initially secured relative to the housing via a plurality of shear screws 164. More specifically, the shear screws 164 are provided in a lower connector sub 165 which is secured to the housing 24 via a threaded connector 167 (and thus may be considered to be part of the housing 24), wherein the lower connector sub 165 includes the lower connector 28 and also defines the load shoulder 152 which is engaged by the power spring 146. The shear screws must initially be sheared by a predefined axially directed shear force to allow the first sleeve assembly 70 to move within the housing 24. The housing 24 includes a cover sleeve 166 threadedly secured over the shear screws 164, allowing improved access to the screws 164 and thus allowing the valve 18 to be more readily configured for an intended application.

The second sleeve assembly 76 includes an upper sleeve portion 76*a* and a lower sleeve position 76*b* coupled together via a threaded connector 168. The upper sleeve portion 76*a* extends inside the lower sleeve portion 76*b*, and defines the load shoulder 90 for the biasing spring 86.

A ratchet arrangement 170 is provided between the second sleeve assembly 76 and the housing 24 to permit relative movement therebetween in only a single direction. The ratchet arrangement 170 includes a ratchet profile 172 formed on the inner surface of the housing, and a split ratchet ring 174 which is axially captivated between the upper and lower portions 76*a*, 76*b* of the second sleeve assembly 76.

The upper sleeve portion 76*a* is initially secured relative to the housing 24 via a shear arrangement 176 which includes a ring member 178 axially captivated between a no-go profile 180 formed on the housing 24 and an upper connector sub 182, and a plurality of shear screws 179 which extend through the ring member 178 to engage the upper sleeve portion 76*a*. The shear screws 179 define a shear rating which must be exceeded, by an axially applied load, to allow the second sleeve assembly 76 to move within the housing. The upper connector sub includes or defined the upper connector 26, and is secured to the housing 24 via a threaded connector 184 (and thus may be considered to be part of the housing 24).

During use, the downhole valve 18 may be deployed in the closed configuration shown in FIGS. 2 and 3, wherein the valve member 32 is closed and seated against the first valve seat 72. As the valve is tripped downhole, fluid below the valve member 32 may function to lift the valve member 32 from the first seat 72, against the bias of the bias spring 86 and sleeve 84, thus allowing the associated completion assembly 10 (FIG. 1A) to fill.

Once the completion assembly 10 is deployed to the required depth, pressure above the valve member 32 may be elevated, establishing a pressure differential across the valve member 32, with the result that the valve member 32 is pressed and sealed against the first valve seat 72 by action of the pressure differential and the bias spring 86 and sleeve 84. Accordingly, elevated fluid pressure above the valve member 32 may be used to set the packer 16 (FIG. 1A).

Fluid pressure above the valve member 32 may also be communicated through said valve member 32, via the blind bore 40 and throughbore 34, to act against the circumferential rib 142 of the primary drive arrangement 140, such that the pressure may apply a downward axial force on the first sleeve assembly 70. It will of course be appreciated that the net force acting on the circumferential rib 142 is achieved by the pressure differential across the valve member 32. The downward force will also be applied on the second sleeve assembly 76 through engagement of the upset portions 104, 106 of the first and second interface arms 96, 98 with the shoulders 120, 122 of the first sleeve assembly 70.

Figure 8:
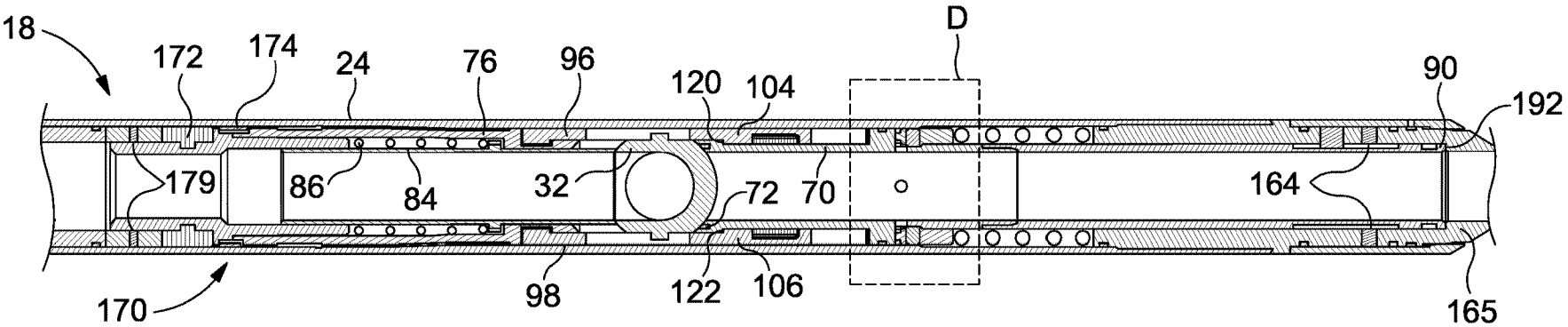
FIG. 8 is a longitudinal sectional view of the downhole valve of FIG. 2, in an initial stage of actuation performed by a primary mode of actuation.

When the downward force exceeds the shear rating of the shear screws 164 associated with the first sleeve assembly and shear screws 179 associated with the second sleeve assembly 76, said screws 164, 179 will shear, thus permitting the first and second sleeve assemblies 70, 76 to be driven in a downwards direction, as illustrated in FIG. 8, reference to which is now made. This downward movement may be defined as a preliminary movement. Such movement of the first and second sleeve assemblies 70, 76 is in a common downhole direction such that relative movement therebetween does not occur, with the valve member 32 thus remaining closed and sealingly engaged with the first valve seat 72. The ratchet arrangement 170 provided between the second sleeve assembly 76 and the housing 24 prevents any reverse movement of the second sleeve assembly 76.

Figure 9:
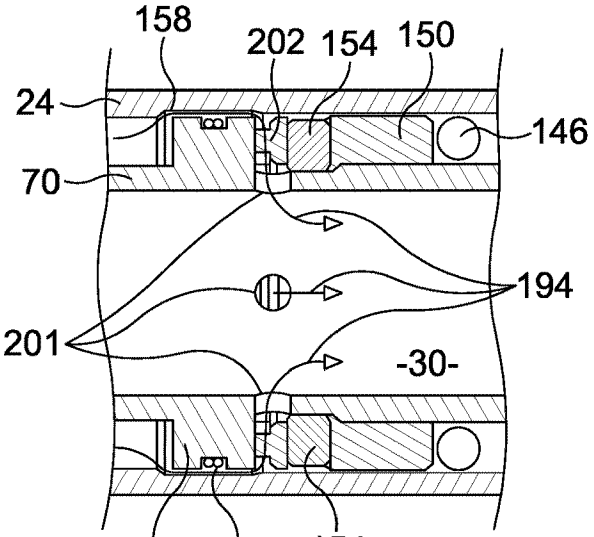
FIG. 9 is an enlarged view of region D of FIG. 8.

Downward movement of the first and second sleeve assemblies 70, 76 may occur until the lower end 190 of the first sleeve assembly 70 engages a lower shoulder 192 formed on the lower connector sub 165. This position may be referred to as a release position. With reference additionally to FIG. 9, which is an enlarged view of region D in FIG. 8, when the release position is achieved the dogs 154 are aligned with a circumferential release recess 200 formed on an outer surface of the first sleeve assembly 70, desupporting or unsupporting the dogs 154 and allowing these to become released from the retaining recess 158 formed in the housing 24, thus releasing the isolator ring 150 from the housing 24. This permits the isolator ring 150 to engage the circumferential rib 142, allowing the force of the power spring 146 to act on the circumferential rib 142 and thus first sleeve assembly 70. In this configuration the pressure differential across the valve member 32 is sufficient to hold the force of the power spring 146, and thus prevent opening of the valve member 32. In fact, in the present example the pressure differential is sufficient to further compress the power spring 146.

When in the illustrated release position the circumferential rib 142 is aligned with the retaining recess 158, effectively removing the effect of the seal 144 against the housing 24, allowing fluid to bypass the rib 142 and into the flow path 30 of the valve 18, in the direction of arrows 194, via ports 201 formed in the first sleeve assembly 70. To assist this fluid bypass the isolator ring 150 includes a plurality of castellated members 202 (also shown in FIG. 6) which define gaps 204 (FIG. 6) therebetween, thus maintaining flow between the circumferential rib 142 and the isolator ring 150 when engaged. This fluid bypass permits pressure on both sides of the valve member 32 to begin to equalise, reducing the downward force applied on the first sleeve assembly 70 until the force of the power spring 146 begins to dominate to then drive the first sleeve assembly 70 in an upwards direction, as illustrated in FIG. 10.

The ratchet arrangement 170 provided between the second sleeve assembly 76 and the housing 24 prevents any upward movement of the second sleeve assembly 76, such that the first sleeve assembly 70, under the action of the power spring 146, may move axially relative to the second sleeve assembly 76, thus causing the valve member 32 to rotate, via the interface arrangement 94 and the opposed first and second drive structures 42, 44 of the valve member 32. Such axial movement and valve rotation may occur until the throughbore 34 of the valve member 32 is fully aligned with the valve flow path 30, with the third bearing surface 62 of the valve member 32 engaged with the first valve seat 72, and the fourth bearing surface 64 engaged with the second seat 78.

In some embodiments, axial movement between the first and second sleeve assemblies 70, 76 may be permitted until the valve member 32 is brought into engagement with the second valve seat 78. Alternatively, or additionally, movement may be restricted by the length of one or both of the elongate slots 124, 126 formed in the respective interface arms 96, 98.

The ratchet system 130 provided between the interface arrangement 94 and the first sleeve assembly 70 prevents any reverse movement of the first and second sleeve assemblies 70, 76, which would otherwise cause the valve member 32 to rotate towards its closed position again.

As described above, when the valve 18 is operated in its primary mode of actuation, the first sleeve assembly 70 is caused to move, by an internal drive force provided by the power spring 146, towards the second sleeve assembly 76 which is held in place by the ratchet arrangement 170. While this primary mode of actuation requires manipulation of pressure, it may nevertheless be defined as an automatic mode of actuation as no physical downhole intervention of an operator is required.

However, as will now be described with reference to FIG. 11, the valve 18 may also be operated in a secondary mode of actuation, which may be used in the event that the primary mode of actuation is not possible, for example if the first sleeve assembly 70 should become jammed in the housing, if the pressure integrity above the valve member 32 is compromised, or the like. In the present embodiment the secondary mode of actuation may be defined as a manual mode of actuation, in that physical intervention of an operator is required.

Figure 11:
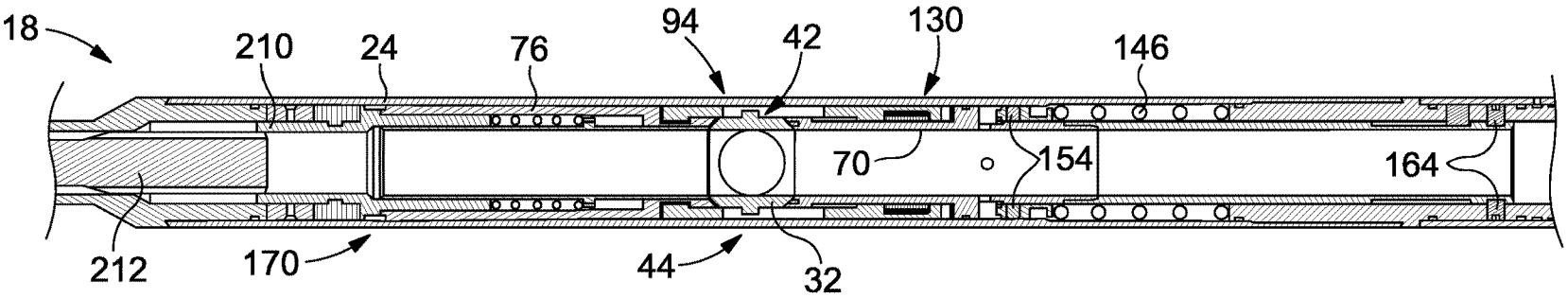
FIG. 11 is a longitudinal sectional view of the downhole valve of FIG. 2, shown actuated in a secondary mode of actuation.

As illustrated in FIG. 11, the second sleeve assembly 76 includes a tool interface 210 at an upper end thereof which permits engagement with a tool 212, such as a jarring tool, deployed from surface, for example on wireline, coiled tubing or the like. Once engaged, the tool 212 applies a downward force, for example a jarring force on the second sleeve assembly 76, causing the shear screws 179 to shear, allowing the tool 212 to then move the second sleeve assembly 76 in a downward direction. As the first sleeve assembly 70 remains fixed relative to the housing 24 via the shear screws 164, the second sleeve assembly 76 thus moves axially relative to the first sleeve assembly 70, causing the valve member 32 to rotate towards its open position by interaction of the interface arrangement 94 and the first and second drive structures 42, 44 of the valve member 32.

As also in the primary mode of actuation, the ratchet arrangement 170 provided between the second sleeve assembly 76 and the housing 24 locks the second sleeve assembly 76 against any return movement. Also, the ratchet system 130 provided between the interface arrangement 94 and the first sleeve assembly prevents any relative axial movement of the first and second sleeve assemblies 70, 76 in a direction which would otherwise cause the valve member 32 to rotate towards its closed position.

The valve 18 also includes features which permit other contingency operations to be performed, such as a milling operation to provide full bore access through the valve 18. For example, and with reference again to FIG. 3, the first sleeve assembly 70 is rotatably secured relative to the housing 24 via a key 220 which is axially fixed to the housing 24 and which engages an elongate key-way 222 formed in the first sleeve assembly 70. Also, the first and second sleeve assemblies 70, 76 are rotationally locked together by virtue of the engagement of the interface arms 96, 98 with the respective planar surfaces 112, 114 formed on the first sleeve assembly 70. Also, the engagement of the rotation pins 50, 52 of the valve member 32 within the respective elongate slots 124, 126 of the interface arms 96, 98 also allows the valve member 32 to be rotatably fixed, along the longitudinal axis of the valve 18, relative to the first and second sleeve assemblies 70, 76. Furthermore, various threaded connections, such as connection 162, may be arranged so as not to become uncoupled during any rotational action of a machine (e.g., milling) tool.

Furthermore, the form of the valve member 32 provides advantages during milling operations. For example, the blind bore 40 may present less material to be machined. Further, the blind bore 40 may facilitate centering of any machine tool, minimising the risk or occurrence of a machine tool kicking-off the valve member 32 and possibly damaging other components, such as the housing 24.

Figure 12:
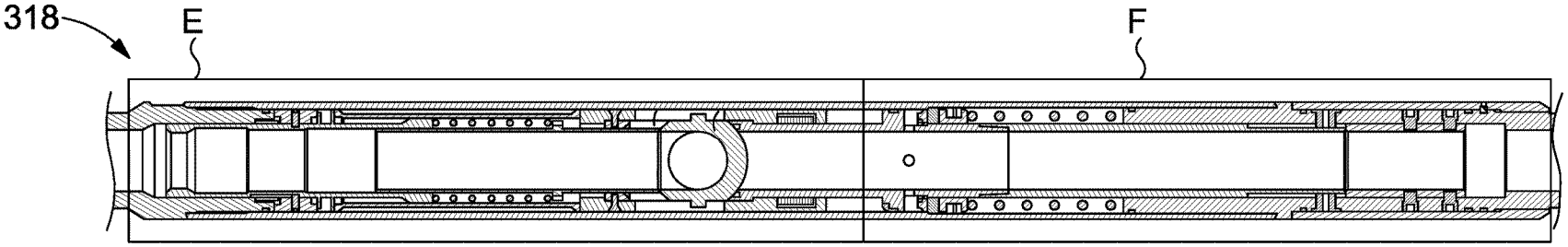
FIG. 12 is a longitudinal cross-sectional view of a downhole valve in accordance with another embodiment of the present invention, wherein the valve is shown in an initial closed configuration.
Figure 13:
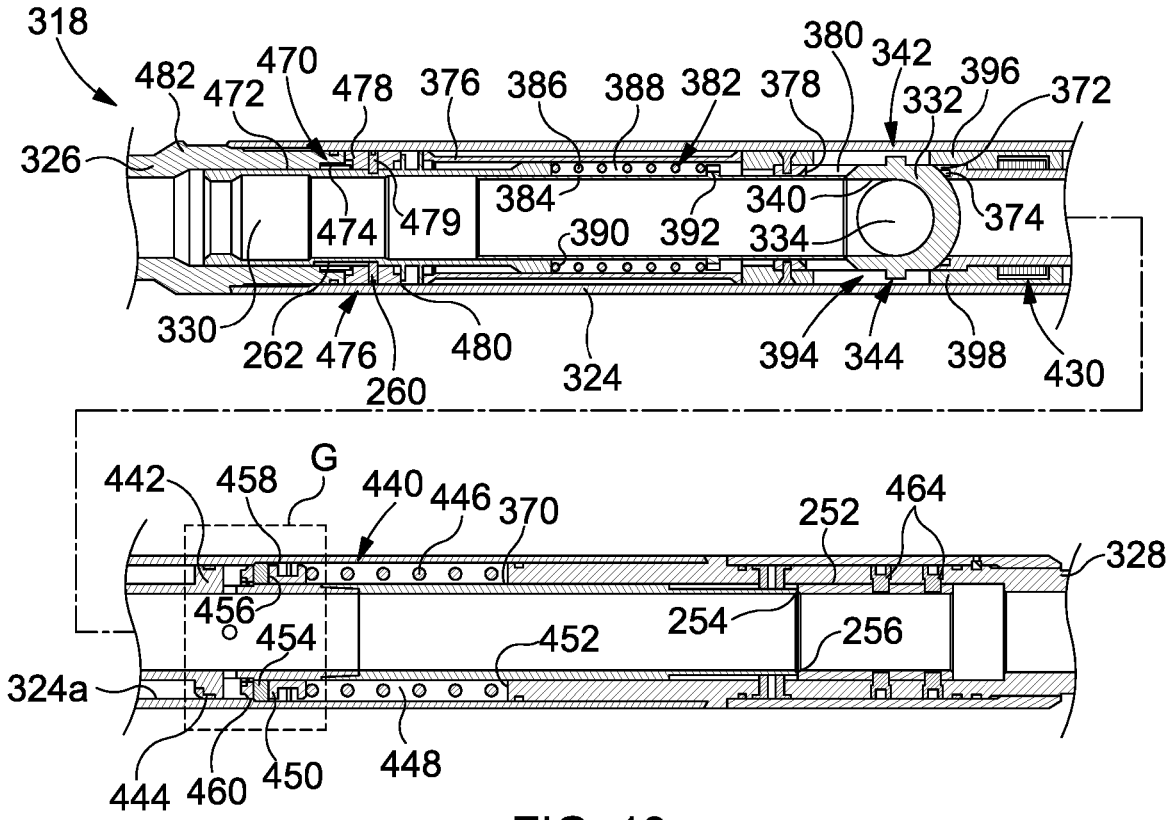
FIG. 13 provides enlarged views of adjacent sections E and F of the downhole valve of FIG. 12.

FIG. 12 provides a longitudinal cross-sectional view of a downhole valve 318 in accordance with an alternative embodiment of the present invention, and for purposes of clarity FIG. 13 provides enlarged views of adjacent sections E and F of FIG. 12. The subsequent description is made primarily with reference to FIG. 13, with FIG. 12 providing a useful global illustration of the valve 318.

It should be understood that the valve 318 in the present embodiment may be utilised in place of valve 18 in FIG. 1. Furthermore, valve 318 is largely similar in form and function to valve 18, and as such like features share like reference numerals, incremented by 300. Due to the significant similarities between valves 18 and 318, for purposes of brevity only certain features of the valve 318 will be described, in particular to highlight the differences/modifications.

The valve 318 includes a housing 324 which defines a flow path 330 extending between upper and lower connectors 326, 328, with a rotatable valve member 332 provided within the housing 324 to control flow along the flow path 330. In FIGS. 12 and 13 the valve member 332 is shown in a closed position in which a valve throughbore 334 is not aligned with the flow path 330. The valve member 332 is identical to valve 32 previously described, for example with reference to 4A to 4C, and as such no further description will be given.

The valve 318 includes a first sleeve assembly 370 mounted in the housing 324 on one side of the valve member 332 (on the downhole side of the valve member 332 in the example embodiment illustrated). The first sleeve assembly 370 includes a first valve seat 372 which carries a seal 374.

The valve 318 further includes a second sleeve assembly 376 mounted in the housing on an opposite side of the valve member 332 (on the uphole side of the valve member 332 in the example embodiment illustrated), wherein the second sleeve assembly 376 includes a second valve seat 378.

An axial pocket 380 is defined between the first and second sleeve assemblies 370, 376, specifically between the first and second valve seats 372, 378. The valve member 332 is positioned within the axial pocket 380, and in the closed position shown in FIG. 13 the valve member 332 is engaged with the first valve seat 372 and separated from the second valve seat 378.

A biasing arrangement 382 is mounted on the second sleeve assembly 376 and includes a biasing sleeve 384 which axially engages the valve member 332, and a biasing spring 386 located in an annular space 388 defined between the second sleeve assembly 376 and the biasing sleeve 384 and acts between a load shoulder 390 on the second sleeve assembly 376 and a load shoulder in the form of an annular rib 392 on the biasing sleeve 384. Accordingly, the spring 386 generates a bias force which acts to bias the biasing sleeve 384 against the valve member 332, and thus biases the valve member 332 against the first valve seat 372.

The downhole valve 318 further includes an interface arrangement 394 extending between the first and second sleeve assemblies 370, 376 wherein the interface arrangement 394 engages opposed first and second drive structures 342, 344 of the valve member 332 to establish an interface mechanism which functions to cause rotation of the valve member 332 upon relative axial movement of the first and second sleeve assemblies 370, 376. The interface arrangement 394 includes first and second diametrically opposed interface arms 396, 398 which extend from the second sleeve assembly 376 to the first sleeve assembly 370, spanning the axial pocket 380. The interface arrangement 394 in the present embodiment is similar to arrangement 94 described previously and as such no further description will be given.

The valve 318 includes a ratchet system 430 provided between the first sleeve assembly 370 and the first and second interface arms 396, 398 and configured to permit relative movement of the first and second sleeve assemblies 370, 376 only in a direction which causes the valve member 332 to rotate from its closed position towards an open position. Accordingly, reverse rotation of the valve member 332 is not permitted, such that the valve 318 in the embodiment shown may define a one-shot open valve. The ratchet system 430 is similar to system 130 previously described and as such no further description will be provided.

The valve 318 further comprises a primary drive arrangement, generally identified by reference numeral 440, associated with the first sleeve assembly 370 and for causing movement of the first sleeve assembly 370 relative to the second sleeve assembly 376. The primary drive arrangement 440 is for operating the downhole valve 318 in its primary mode of actuation.

Figure 14:
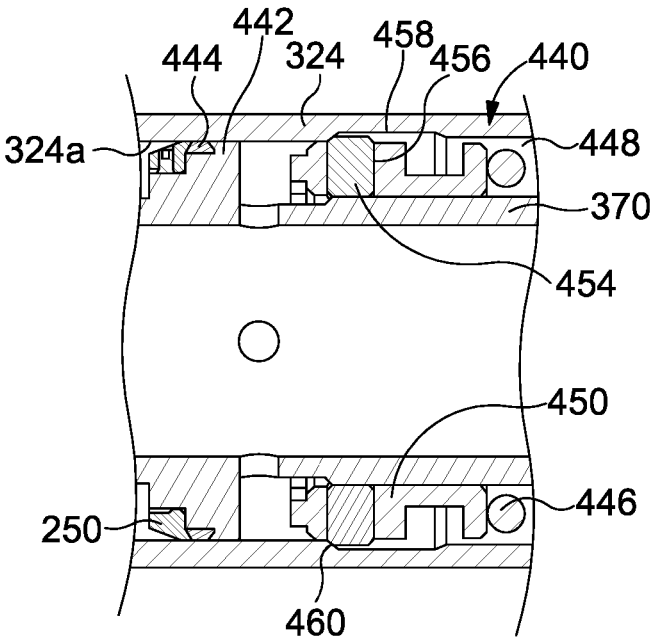
FIG. 14 provides an enlarged view of region G of FIG. 13.

The primary drive arrangement 440 comprises a primary drive interface in the form of a circumferential rib 442 formed on the first sleeve assembly 370. The circumferential rib 442 is sealably engaged with the housing 324, specifically a sealing surface 324*a* of the housing 324, via a seal member 444, and thus defines a piston arrangement. Reference is additionally made to FIG. 14 which provides an enlarged view in region G of FIG. 13, specifically in the region of the circumferential rib 442. The seal member 444 is radially clamped or captivated by a circumferential clamping ring 250. As will be described in more detail below, such radial retention of the seal member 444 may minimise the risk of displacement of the seal member 444 which might otherwise cause binding of the first sleeve assembly 370 relative to the housing 324.

The primary drive arrangement 340 comprises a primary drive force generator in the form of a power spring 446 located in an annular space 448 formed between the first sleeve assembly 370 and the housing 324 on the downhole side of the circumferential rib 442. As described in more detail below, the power spring 446 functions to establish a sufficient primary drive force against the circumferential rib 442 to move the first sleeve assembly 370 relative to the second sleeve assembly 376 when the downhole valve 318 is operated in its primary mode of actuation.

The primary drive arrangement 440 also comprises a force isolator in the form of an isolator ring 450 which is located within the annular space 448, wherein the power spring 446 acts between the isolator ring 450 and a load shoulder 452 coupled to the housing 324. The isolator ring 450 functions to initially isolate the primary drive force from acting on the circumferential rib 442. The isolator ring 450 may therefore function as a trigger.

The isolator ring 450 is initially axially secured relative to the housing 324 via a plurality of dogs 454 which extend through respective radial pockets 456 in the isolator ring 450 and are received within a circumferential retaining recess 458 formed in the inner surface of the housing 424, adjacent to the sealing surface 324*a*. When in the configuration of FIG. 13 the first sleeve assembly 370 radially supports the dogs 454 within the retaining recess 458, thus effectively locking the isolator ring 450 relative to the housing 324. The power spring 446 applies an axial force on the isolator ring 450 such that the dogs 454 engage a no-go profile 460 formed by the retaining recess 458. The isolator ring 450 is thus retained at a position which is separated from the circumferential rib 442, as illustrated in FIGS. 13 and 14, to prevent the force of the power spring 446 from being applied on said rib 442 and thus the first sleeve assembly 370.

The valve 318 includes a lock sleeve 252 which is initially secured relative to the housing 324 via a plurality of shear screws 464. When in the illustrated initial configuration, a lower end 254 of the first sleeve assembly 370 axially engages an upper end 256 of the lock sleeve 252. In use, the primary sleeve assembly 370 must apply a sufficient force against the lock sleeve 252 to cause the shear screws to be sheared to allow the first sleeve assembly 370 to move within the housing 324.

A ratchet arrangement 470 is provided between the second sleeve assembly 376 and the housing 324 (specifically an upper connector sub 482 which forms part of the housing 324) to permit relative movement therebetween in only a single direction. The ratchet arrangement 470 includes a ratchet profile 472 formed on the outer surface of the second sleeve assembly 376, and a split ratchet ring 474 which is axially captivated in a recess formed in the housing 324.

The second sleeve assembly 376 is initially secured relative to the housing 324 via a shear arrangement 476 which includes a ring member 478 axially captivated between a no-go profile 480 formed on the housing 324 and the upper connector sub 482, and a plurality of shear screws 479 which extend through the ring member 478 to engage the second sleeve assembly 376. The shear screws 379 define a shear rating which must be exceeded, by an axially applied load, to allow the second sleeve assembly 76 to move within the housing.

The ring member 478 also carries a limit screw 260 which is received within a slot 262 formed in the outer surface of the second sleeve assembly 376. The limit screw 260 and slot 262 function to provide an end-stop for movement of the first and second sleeve assemblies 370, 376, to assist to provide protection of the interface arrangement 394 and features of the valve member 332 for damage or compromise due to impact or impulse loading.

During use, the downhole valve 318 may be deployed in the closed configuration shown in FIGS. 12 and 13, wherein the valve member 332 is closed and seated against the first valve seat 372. As the valve is tripped downhole, fluid below the valve member 332 may function to lift the valve member 332 from the first seat 372, against the bias of the bias spring 386 and sleeve 384, thus allowing an associated completion assembly (e.g., assembly 10 of FIG. 1A) to fill.

Once the completion assembly 10 is deployed to the required depth, pressure above the valve member 332 may be elevated, establishing a pressure differential across the valve member 332, with the result that the valve member 332 is pressed and sealed against the first valve seat 372 by action of the pressure differential and the bias spring 386 and sleeve 384. Accordingly, elevated fluid pressure above the valve member 332 may be used for other operations (e.g., to set the packer 16 in FIG. 1A).

Fluid pressure above the valve member 332 may also be communicated through said valve member 332, via a blind bore 340 and throughbore 334, to act against the circumferential rib 442 of the primary drive arrangement 440, such that the pressure may apply a downward axial force on the first sleeve assembly 370. It will of course be appreciated that the net force acting on the circumferential rib 442 is achieved by the pressure differential across the valve member 332. The downward force will also be applied on the second sleeve assembly 376 via the first and second interface arms 396, 398.

Figure 15:
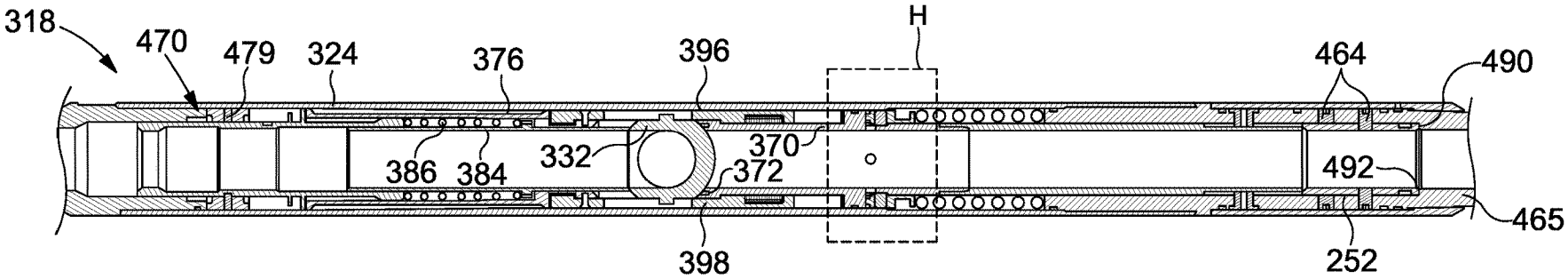
FIG. 15 is a longitudinal sectional view of the downhole valve of FIG. 12, in an initial stage of actuation performed by a primary mode of actuation.

When the downward force exceeds the shear rating of the shear screws 464 associated with the lock sleeve 252 and shear screws 479 associated with the second sleeve assembly 376, said screws 464, 479 will shear, thus permitting the first and second sleeve assemblies 370, 376 to be driven in a downwards direction, as illustrated in FIG. 15, reference to which is now made. This downward movement may be defined as a preliminary movement. Such movement of the first and second sleeve assemblies 370, 376 is in a common downhole direction such that relative movement therebetween does not occur, with the valve member 332 thus remaining closed and sealingly engaged with the first valve seat 372. The ratchet arrangement 470 provided between the second sleeve assembly 376 and the housing 324 prevents any reverse movement of the second sleeve assembly 376.

Downward movement of the first and second sleeve assemblies 70, 76 may occur until the lower end 490 of the lock sleeve 252 engages a lower shoulder 492 formed on a lower connector sub 465. This position may be referred to as a release position.

Although not illustrated, an energy absorber (such as a crumple zone) may be provided within the valve 318, for example interposed between the lower end 490 of the lock sleeve 252 and the lower shoulder 492 of the lower connector sub. Such an energy absorber may minimise impulse loading within the valve 318.

Figure 16:
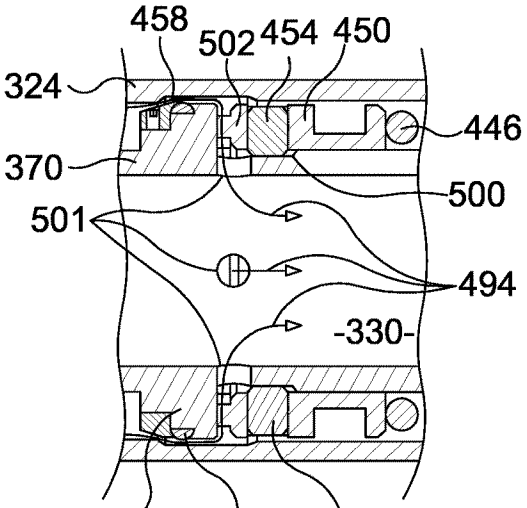
FIG. 16 is an enlarged view of region H of FIG. 15.

With reference additionally to FIG. 16, which is an enlarged view of region H in FIG. 15, when the release position is achieved the dogs 454 are aligned with a circumferential release recess 500 formed on an outer surface of the first sleeve assembly 370, desupporting the dogs 454 and allowing these to become released from the retaining recess 458 formed in the housing 324, thus releasing the isolator ring 450 from the housing 424. This permits the isolator ring 450 to engage the circumferential rib 442, allowing the force of the power spring 446 to act on the circumferential rib 442 and thus first sleeve assembly 370. In this configuration the pressure differential across the valve member 332 is sufficient to hold the force of the power spring 446, and thus prevent opening of the valve member 332. In fact, in the present example the pressure differential is sufficient to further compress the power spring 446.

When in the illustrated release position the circumferential rib 442 is aligned with the retaining recess 458, effectively removing the effect of the seal 444 against the housing 324, allowing fluid to bypass the rib 442 and into the flow path 330 of the valve 318, in the direction of arrows 494, via ports 501 formed in the first sleeve assembly 370. In this respect, as the seal member 444 is radially captivated by the clamp ring, the fluid bypassing the rib 442 will not cause this seal member 444 to be washed out or radially displaced, avoiding or minimising any issues with the seal 444 binding against the housing 324 during reverse movement.

Figure 17:
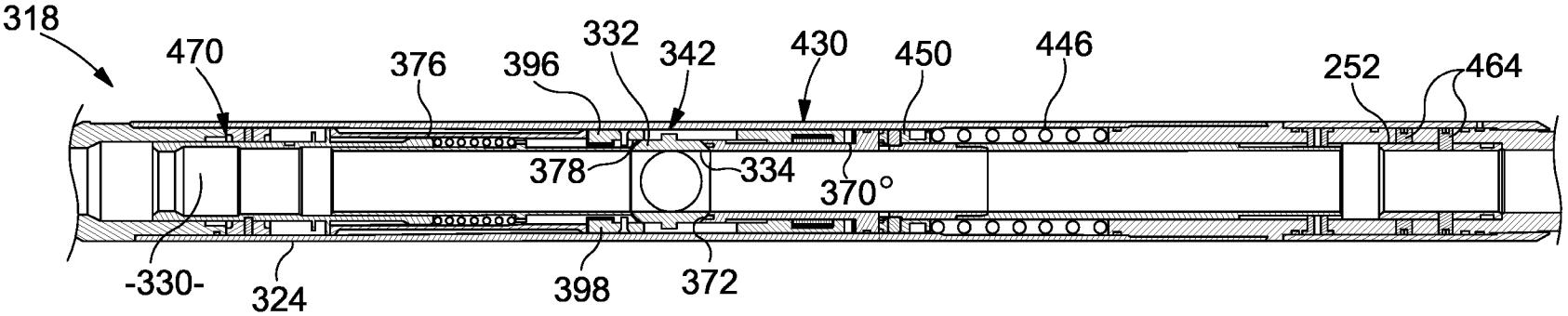
FIG. 17 is a longitudinal sectional view of the downhole valve of FIG. 12, wherein the valve is shown in an open configuration.

To assist the fluid bypass the isolator ring 450 includes a plurality of castellated members 502 which define gaps therebetween, thus maintaining flow between the circumferential rib 442 and the isolator ring 450 when engaged. This fluid bypass permits pressure on both sides of the valve member 332 to begin to equalise, reducing the downward force applied on the first sleeve assembly 370 until the force of the power spring 446 begins to dominate to then drive the first sleeve assembly 370 in an upwards direction, as illustrated in FIG. 17. In this respect, the first sleeve assembly 370 is moved independently of the lock ring 252. As such, the sheared screws 464 will not interference with or cause drag on the first sleeve assembly 370.

The ratchet arrangement 470 provided between the second sleeve assembly 376 and the housing 324 prevents any upward movement of the second sleeve assembly 376, such that the first sleeve assembly 370, under the action of the power spring 446, may move axially relative to the second sleeve assembly 376, thus causing the valve member 332 to rotate, via the interface arrangement 394 and the opposed first and second drive structures 342, 344 of the valve member 332. Such axial movement and valve rotation may occur until the throughbore 334 of the valve member 332 is fully aligned with the valve flow path 330.

In some embodiments, axial movement between the first and second sleeve assemblies 370, 376 may be permitted until the valve member 332 is brought into engagement with the second valve seat 378.

The ratchet system 430 provided between the interface arrangement 394 and the first sleeve assembly 370 prevents any reverse movement of the first and second sleeve assemblies 370, 376, which would otherwise cause the valve member 332 to rotate towards its closed position again.

As described above, when the valve 318 is operated in its primary mode of actuation, the first sleeve assembly 370 is caused to move, by an internal drive force provided by the power spring 446, towards the second sleeve assembly 376 which is held in place by the ratchet arrangement 470. While this primary mode of actuation requires manipulation of pressure, it may nevertheless be defined as an automatic mode of actuation as no physical downhole intervention of an operator is required.

However, as will now be described with reference to FIG. 18, the valve 318 may also be operated in a secondary mode of actuation, which may be used in the event that the primary mode of actuation is not possible, for example if the first sleeve assembly 370 should become jammed in the housing, if the pressure integrity above the valve member 332 is compromised, or the like. In the present embodiment the secondary mode of actuation may be defined as a manual mode of actuation, in that physical intervention of an operator is required.

Figure 18:
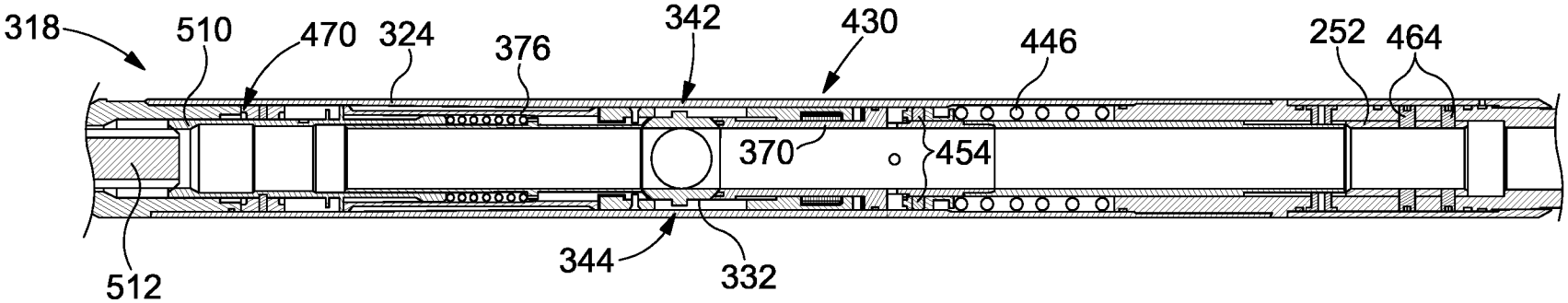
FIG. 18 is a longitudinal sectional view of the downhole valve of FIG. 12, shown actuated in a secondary mode of actuation.

As illustrated in FIG. 18, the second sleeve assembly 376 includes a tool interface 510 at an upper end thereof which permits engagement with a tool 512, such as a jarring tool, deployed from surface, for example on wireline, coiled tubing or the like. Once engaged, the tool 512 applies a downward force, for example a jarring force on the second sleeve assembly 376, causing the shear screws 479 to shear, allowing the tool 512 to then move the second sleeve assembly 376 in a downward direction. As the first sleeve assembly 370 remains fixed relative to the housing 324 via the shear screws 464, the second sleeve assembly 376 thus moves axially relative to the first sleeve assembly 370, causing the valve member 332 to rotate towards its open position by interaction of the interface arrangement 394 and the first and second drive structures 342, 344 of the valve member 332.

As also in the primary mode of actuation, the ratchet arrangement 470 provided between the second sleeve assembly 376 and the housing 324 locks the second sleeve assembly 376 against any return movement. Also, the ratchet system 430 provided between the interface arrangement 394 and the first sleeve assembly 370 prevents any relative axial movement of the first and second sleeve assemblies 370, 376 in a direction which would otherwise cause the valve member 332 to rotate towards its closed position.

It should be understood that the embodiments described herein are merely exemplary and that various modifications may be made thereto without departing from the scope of the invention. For example, and with reference again to FIG. 9, in the primary mode of actuation described above, pressure equalisation across the valve member 32 is achieved by permitting fluid from above the valve member 32 to bypass the circumferential rib 142. However, in other embodiments such fluid bypass may not be permitted, for example by retaining the seal member 144 in contact with the housing 24. In such an embodiment the pressure above the valve member 32 may be intentionally reduced, for example controlled from surface, allowing the power spring 146 to then dominate and move the first sleeve assembly 70. In some embodiments the seal member 144 may be retained in engagement with the housing 24 by use of a spacer installed between the lower end 190 of the first sleeve assembly 70 and the shoulder 192 provided on the lower connector sub 165. The spacer may be selected to have an axial length such that the seal 144 cannot become aligned with the retaining recess 158.

Also, it should be understood that terms used herein such as "above", "below", "downwards" and "upwards" are not intended to limit the valve 18 for use in a strict orientation. Instead, these terms are used for convenience of the present description, and it will be recognised that the valve may be installed in any orientation.

Furthermore, although a specific embodiment of providing the valve in combination with a packer is disclosed, any other downhole tool other than a packer may be used.

The invention claimed is:

1. A downhole valve, comprising:

a housing;

first and second sleeve assemblies mounted within the housing and defining an axial pocket therebetween, wherein the first and second sleeve assemblies are arranged to be moved axially relative to each other to vary the size of the axial pocket;

a valve member mounted within the axial pocket and being rotatable about a rotation axis in response to relative axial movement of the first and second sleeve assemblies from a closed position in which fluid flow through the downhole valve is restricted towards an open position in which fluid flow through the downhole valve is increased or permitted; and an interface arrangement axially extending from the second sleeve assembly and engaging the valve member via an interface mechanism for converting relative axial movement of the first and second sleeve assemblies to rotation of the valve member, wherein the downhole valve comprises:

a primary mode of actuation in which one of the first and second sleeve assemblies is moved to provide rotation of the valve member; and a secondary mode of actuation in which the other of the first and second sleeve assemblies is moved to provide rotation of the valve member.

2. The downhole valve according to claim 1, wherein when the valve member is in its closed position the axial pocket defined between the first and second sleeve assemblies is larger than the valve member, and when the valve member is in its open position the size of the axial pocket is reduced.

3. The downhole valve according to claim 1, wherein the first sleeve assembly comprises a first valve seat and the valve member is sealably engageable with said first valve seat, wherein the first valve seat defines an axial edge or boundary of the axial pocket.

4. The downhole valve according to claim 3, wherein the second sleeve assembly comprises a second valve seat and the second valve seat defines an axial edge or boundary of the axial pocket, wherein only one of the first and second valve seats is engaged with the valve member when said valve member is in its closed position, and both of the first and second valve seats are engaged with the valve member when said valve member is in its open position.

5. The downhole valve according to claim 1, wherein the first and second sleeve assemblies are moveable axially relative to each other in a single axial direction to cause the valve member to rotate from its closed position to its open position, wherein relative movement of the first and second sleeve assemblies in the single axial direction causes the axial pocket to one of reduce or increase in the axial direction.

6. The downhole valve according to claim 1, wherein:

in the primary mode of actuation the second sleeve is stationary relative to the housing and the first sleeve assembly is moved towards the second sleeve assembly; and in the secondary mode of actuation the first sleeve is stationary relative to the housing and the second sleeve assembly is moved towards the first sleeve assembly.

7. The downhole valve according to claim 1, comprising a primary drive arrangement associated with one of the first and second sleeve assemblies for operating the downhole valve in its primary mode of actuation, wherein the sleeve assembly associated with the primary drive arrangement is defined as the primary sleeve assembly.

8. The downhole valve according to claim 7, wherein the primary drive arrangement comprises a primary drive interface provided on the primary sleeve assembly, wherein the primary drive interface permits a drive force to act on and drive the primary sleeve assembly.

9. The downhole valve according to claim 8, wherein the primary drive arrangement comprises a primary drive force generator for establishing a primary drive force suitable to cause relative movement of the first and second sleeve assemblies when the downhole valve is operated in its primary mode of actuation, the primary drive force generator being arranged to generate a force against the primary drive interface.

10. The downhole valve according to claim 9, wherein the primary drive arrangement comprises a force isolator for initially isolating the primary drive force from acting on the primary sleeve assembly, said force isolator being actuatable to permit the primary drive force to subsequently act on the primary sleeve assembly.

11. The downhole valve according to claim 10, wherein the force isolator comprises an isolator member which is initially separated from the primary drive interface to prevent the primary drive force from being applied on the primary drive interface and thus prevent any relative movement of the first and second sleeve assemblies to cause rotation of the valve member, wherein upon actuation of the force isolator the isolator member is arranged to move to engage the primary drive interface and thus allow the primary drive force to act on the primary sleeve assembly.

12. The downhole valve according to claim 10, wherein the force isolator is actuatable upon preliminary movement of the primary sleeve assembly, said preliminary movement being in a release direction which is opposite to that required to cause rotation of the valve member.

13. The downhole valve according to claim 12, wherein both the first and second sleeve assemblies are moveable in the release direction such that relative axial movement between the sleeve assemblies is not provided during the preliminary movement of the primary sleeve assembly.

14. The downhole valve according to claim 12, wherein preliminary movement of the primary sleeve assembly is provided by action of fluid pressure within the downhole valve acting on the primary drive interface of the primary sleeve assembly.

15. The downhole valve according to claim 14, wherein the primary drive force acts to move the primary sleeve assembly, following release of the isolator member, upon reduction of the pressure used to cause preliminary movement of said primary sleeve assembly.

16. The downhole valve according to claim 12, wherein the primary drive interface is sealingly engaged with the housing such that fluid pressure within the downhole valve may act on the primary drive interface to cause the preliminary movement of the primary sleeve assembly, wherein the housing comprises a relief region and alignment of the primary drive interface with the relief region disrupts sealing engagement with the housing, such that the fluid/pressure may bypass the primary drive interface and permit pressure to equalise across the valve member.

17. The downhole valve according to claim 16, wherein the relief region is provided by a no-go region for use in permitting the isolator member to be secured relative to the housing.

18. The downhole valve according to claim 7, comprising a secondary drive arrangement associated with one of the first and second sleeve assemblies, wherein the sleeve assembly associated with the secondary drive arrangement is defined as the secondary sleeve assembly.

19. The downhole valve according to claim 18, wherein the secondary drive arrangement comprises a secondary drive interface provided on the secondary sleeve assembly, the secondary drive interface permitting a drive force to act on and drive the secondary sleeve assembly.

20. The downhole valve according to claim 19, wherein the secondary drive interface is configured to be engaged by a separate tool deployed through the downhole valve.

21. The downhole valve according to claim 1, wherein the interface arrangement comprises an interface member axially extending from the second sleeve assembly and across the axial pocket defined between the first and second sleeve assemblies, the interface mechanism being provided between the interface member and the valve member.

22. The downhole valve according to claim 21, wherein the interface member is axially secured relative to the second sleeve assembly.

23. The downhole valve according to claim 21, wherein the interface member extends from the second sleeve assembly to slidingly engage the first sleeve assembly.

24. The downhole valve according to claim 1, wherein the valve member comprises:

a through bore which facilitates flow through the downhole valve when the valve member is open, said through bore being generally perpendicular relative to the rotational axis of the valve member; and a blind bore extending transverse to the through bore, wherein when the valve member is in its closed position an axis of the blind bore is aligned with a flow path extending through the downhole valve.

25. A method for controlling flow downhole, comprising:

positioning a valve member of a downhole valve in a closed position, wherein the valve member is located in an axial pocket defined between first and second sleeve assemblies; and establishing relative axial movement between the first and second sleeve assemblies to vary the size of the axial pocket and cause the valve member to rotate from its closed position to an open position, wherein relative axial movement of the first and second sleeve assemblies is converted to rotation of the valve member by engagement between a ball valve and an interface mechanism of an interface assembly which extends from the second sleeve assembly, wherein establishing relative axial movement between the first and second sleeve assemblies comprises:

operating the downhole valve in a primary mode of a primary mode of actuation in which one of the first and second sleeve assemblies is moved to provide rotation of the valve member: and operating the downhole valve in a secondary mode of actuation in which the other of the first and second sleeve assemblies is moved to provide rotation of the valve member.

26. A downhole valve, comprising:

a housing;

first and second sleeve assemblies mounted within the housing and defining an axial pocket therebetween, wherein the first and second sleeve assemblies are arranged to be moved axially relative to each other to vary the size of the axial pocket;

a valve member mounted within the axial pocket and being rotatable about a rotation axis in response to relative axial movement of the first and second sleeve assemblies from a closed position in which fluid flow through the downhole valve is restricted towards an open position in which fluid flow through the downhole valve is increased or permitted; and an interface arrangement axially extending from the second sleeve assembly and engaging the valve member via an interface mechanism for converting relative axial movement of the first and second sleeve assemblies to rotation of the valve member, wherein when the valve member is in its closed position the axial pocket defined between the first and second sleeve assemblies is larger than the valve member, and when the valve member is in its open position the size of the axial pocket is reduced.

27. A downhole valve, comprising:

a housing;

first and second sleeve assemblies mounted within the housing and defining an axial pocket therebetween, wherein the first and second sleeve assemblies are arranged to be moved axially relative to each other to vary the size of the axial pocket;

a valve member mounted within the axial pocket and being rotatable about a rotation axis in response to relative axial movement of the first and second sleeve assemblies from a closed position in which fluid flow through the downhole valve is restricted towards an open position in which fluid flow through the downhole valve is increased or permitted; and an interface arrangement axially extending from the second sleeve assembly and engaging the valve member via an interface mechanism for converting relative axial movement of the first and second sleeve assemblies to rotation of the valve member, wherein the valve member comprises:

a through bore which facilitates flow through the downhole valve when the valve member is open, said through bore being generally perpendicular relative to the rotational axis of the valve member; and a blind bore extending transverse to the through bore, wherein when the valve member is in its closed position an axis of the blind bore is aligned with a flow path extending through the downhole valve.

* * * * *